US007324079B2

(12) United States Patent
Tobita

(10) Patent No.: US 7,324,079 B2
(45) Date of Patent: Jan. 29, 2008

(54) IMAGE DISPLAY APPARATUS

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 306 days.

(21) Appl. No.: 10/494,280

(22) PCT Filed: Nov. 20, 2002

(86) PCT No.: PCT/JP02/12139

§ 371 (c)(1),
(2), (4) Date: Apr. 30, 2004

(87) PCT Pub. No.: WO2004/047067

PCT Pub. Date: Jun. 3, 2004

(65) Prior Publication Data

US 2005/0057470 A1 Mar. 17, 2005

(51) Int. Cl.
*G09G 3/36* (2006.01)

(52) U.S. Cl. ..... 345/100; 345/210

(58) Field of Classification Search ..... 345/304, 345/208–213, 98, 100
See application file for complete search history.

(56) References Cited

U.S. PATENT DOCUMENTS

| | | | | |
|---|---|---|---|---|
| 5,250,937 | A | 10/1993 | Kiuo et al. | |
| 5,376,926 | A | 12/1994 | Sano | |
| 5,640,174 | A | 6/1997 | Kamei et al. | |
| 6,127,997 | A | 10/2000 | Tsuchi | |
| 6,437,716 | B2 | 8/2002 | Nakao | |
| 6,501,252 | B2 | 12/2002 | Fujise | |
| 6,567,327 | B2 * | 5/2003 | Tsuchi | 365/203 |
| 6,614,295 | B2 * | 9/2003 | Tsuchi | 327/563 |
| 6,806,859 | B1 * | 10/2004 | Kanoh et al. | 345/98 |
| 7,009,589 | B1 | 3/2006 | Komiya et al. | |
| 2002/0084840 | A1 | 7/2002 | Tsuchi | |
| 2002/0093475 | A1 | 7/2002 | Hashimoto | |

FOREIGN PATENT DOCUMENTS

| | | |
|---|---|---|
| CN | 1365185 | 8/2002 |
| EP | 1 189 191 A2 | 3/2002 |
| JP | 5-40451 | 2/1993 |

(Continued)

OTHER PUBLICATIONS

Matsueda, et al., "Low-Temperature Poly-Si TFT-LCD with Integrated 6-bit Digital Data Drivers," SID 96 DIGEST, 1996, pp. 21-24.

(Continued)

*Primary Examiner*—Amr A. Awad
*Assistant Examiner*—Steven E Holton
(74) *Attorney, Agent, or Firm*—McDermott Will & Emery LLP

(57) ABSTRACT

A gradation potential generating circuit in a color liquid crystal display device includes 65 resistance elements connected in series and dividing a voltage applied between first and second nodes to generate 64 gradation potentials; a first current amplifier circuit provided corresponding to each gradation potential higher than a precharge potential of a data line and having charging capability higher than discharging capability; and a second current amplifier circuit provided corresponding to each gradation potential lower than the precharge potential and having discharging capability higher than charging capability.

20 Claims, 35 Drawing Sheets

FOREIGN PATENT DOCUMENTS

| | | | |
|---|---|---|---|
| JP | 5-61432 | | 3/1993 |
| JP | 5-297830 | A | 11/1993 |
| JP | 6-67148 | | 3/1994 |
| JP | 7-92937 | | 4/1995 |
| JP | 9-26765 | A | 1/1997 |
| JP | 11-85115 | | 3/1999 |
| JP | 2000-39870 | A | 2/2000 |
| JP | 2000-89691 | | 3/2000 |
| JP | 2001-100656 | | 4/2001 |
| JP | 2001-326545 | A | 11/2001 |
| JP | 2002-123326 | A | 4/2002 |
| JP | 2002-169501 | A | 6/2002 |
| JP | 2002-258821 | A | 9/2002 |
| KR | 2002-0055427 | A | 7/2002 |

OTHER PUBLICATIONS

Matsueda, et al., "A 6-bit-Color VGA Low-Temperature Poly-Si TFT-LCD with Integrated Digital Data Drivers," SID 98 DIGEST, 1998, pp. 879-882.

Kwon, et al., "An Ultra-Low-Power Driving Method for AM-LCD," Asia Display/IDW '01, 2001, pp. 1595-1598.

German Office Action with English translation issued in corresponding German Patent Application No. 102 97 630.9-32, dated Mar. 16, 2007.

Chinese Office Action issued in corresponding Chinese Patent Application No. CN 028233921, dated Jun. 1, 2007.

* cited by examiner

IMAGE DISPLAY APPARATUS

TECHNICAL FIELD

The present invention relates to an image display device, and more particularly to an image display device displaying an image in accordance with an image signal.

BACKGROUND ART

Conventionally in a liquid crystal display device, voltage modulation in which a driving voltage for liquid crystal cells is varied so as to change light transmittance of the liquid crystal cells has been adopted. For 64-gradation display, for example, one voltage out of 64 gradation voltages is selected in accordance with a video signal, and the selected voltage is applied to the liquid crystal cell.

FIG. 37 is a circuit diagram showing a configuration of a gradation potential generating circuit 200 generating 64 gradation potentials V1*d* to V64*d* in such a liquid crystal display device. In FIG. 37, gradation potential generating circuit 200 includes resistance elements R1 to R65 and current amplifier circuits 201.1 to 201.64.

Resistance elements R1 to R65 connected in series between nodes N201 and N200 divide a voltage between nodes N201 and N200 to generate 64 gradation potentials V1*d* to V64*d*. Potentials applied to nodes N200 and N201 are alternately switched in a prescribed cycle in order to prevent deterioration of the liquid crystal cells. FIG. 37 shows a state in which a high potential VH and a low potential VL are applied to nodes N200 and N201 respectively.

Each of current amplifier circuits 201.1 to 201.64 includes a pull-up transistor and a pull-down transistor. The pull-up transistor and the pull-down transistor both have large current drivability. Current amplifier circuits 201.1 to 201.64 output potentials V1*d* to V64*d* of a level the same as gradation potentials V1*d* to V64*d* generated in resistance elements R1 to R65 respectively.

In such gradation potential generating circuit 200, however, when transistors in current amplifier circuits 201.1 to 201.64 have various threshold voltages, both the pull-up transistor and the pull-down transistor are simultaneously rendered conductive depending on an input potential, leading to a flow of a large through current. If such a large through current flows, power consumption in the liquid crystal display device is increased.

FIG. 38 is a circuit diagram showing a configuration of a conventional current amplifier circuit 210. Such a current amplifier circuit 210 is disclosed, for example, in Japanese Patent Laying-Open No. 2002-123326. In FIG. 38, current amplifier circuit 210 includes resistance elements 211 to 213, a pull-type driving circuit 214 and a push-type driving circuit 215. Resistance elements 211 to 213 connected in series between nodes N210 and N213 divide a voltage VH−VL between nodes N210 and N213 to generate an upper limit potential V211 and a lower limit potential V212. Pull-type driving circuit 214 includes an N-type transistor for pull-down, and causes a current to flow out from an output node N215 when a potential VO of output node N215 is higher than upper limit potential V211. Push-type driving circuit 215 includes a P-type transistor for pull-up, and causes a current to flow into output node N215 when potential VO of output node N215 is lower than lower limit potential V212. In this manner, output potential VO is maintained between upper limit potential V211 and lower limit potential V212.

Even in current amplifier circuit 210, however, when transistors in driving circuits 214 and 215 have various threshold voltages, the N-type transistor for pull-up and the P-type transistor for pull-down may simultaneously be rendered conductive, and a large through current flows.

DISCLOSURE OF THE INVENTION

Accordingly, a primary object of the present invention is to provide an image display device consuming low power.

According to the present invention, an image display device displaying an image in accordance with an image signal includes: a plurality of pixel display elements arranged in a plurality of rows and columns and each performing gradation display in accordance with an applied gradation potential; a plurality of scanning lines provided corresponding to the plurality of rows respectively; a plurality of data lines provided corresponding to the plurality of columns respectively; a vertical scanning circuit successively selecting a scanning line from the plurality of scanning lines for a prescribed time period and activating each pixel display element corresponding to the selected scanning line; and a horizontal scanning circuit providing a gradation potential to each pixel display element activated by the vertical scanning circuit in accordance with the image signal. The horizontal scanning circuit includes: a precharge circuit setting each data line to a predetermined precharge potential; a potential generating circuit generating a plurality of gradation potentials different from one another; a first current amplifier circuit provided corresponding to each gradation potential higher than the precharge potential among the plurality of gradation potentials, outputting a potential equal to the corresponding gradation potential, and having charging capability higher than discharging capability; a second current amplifier circuit provided corresponding to each gradation potential lower than the precharge potential among the plurality of gradation potentials, outputting a potential equal to the corresponding gradation potential, and having discharging capability higher than charging capability; and a selection circuit selecting one gradation potential out of the plurality of gradation potentials in accordance with the image signal and providing an output potential of the first or second current amplifier circuit corresponding to the selected gradation potential to each activated pixel display element through each data line. In this manner, as the first current amplifier circuit having charging capability higher than discharging capability and the second current amplifier circuit having discharging capability higher than charging capability are employed, the through current in each current amplifier circuit is reduced and power consumption can be lowered, as compared with a conventional example in which the current amplifier circuit having high charging capability and high discharging capability.

BEST MODES FOR CARRYING OUT THE INVENTION

Embodiment 1

Figure 1:
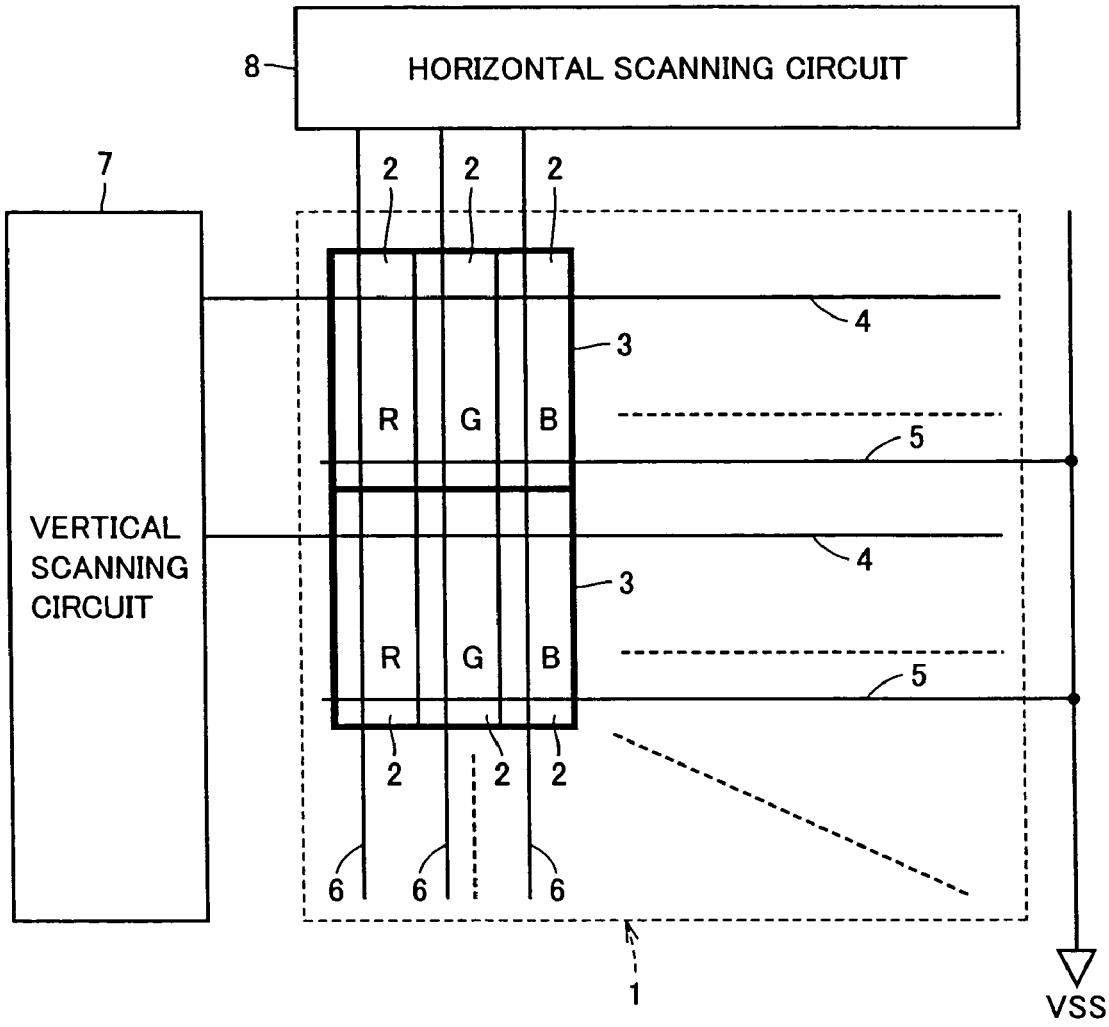
FIG. 1 is a block diagram showing an overall configuration of a color liquid crystal display device in Embodiment 1 of the present invention.

FIG. 1 is a block diagram showing a configuration of a color liquid crystal display device in Embodiment 1 of the present invention. In FIG. 1, the color liquid crystal display device includes a liquid crystal panel 1, a vertical scanning circuit 7 and a horizontal scanning circuit 8, and is provided in a mobile phone terminal, for example.

Liquid crystal panel 1 includes a plurality of liquid crystal cells 2 arranged in a plurality of rows and columns, scanning lines 4 and common potential lines 5 provided corresponding to the rows respectively, and data lines 6 provided corresponding to the columns respectively.

Liquid crystal cells 2 are grouped in advance in three in each row. Three liquid crystal cells 2 in each group are provided with color filters of R, G and B respectively. Three liquid crystal cells 2 in each group constitute one pixel 3.

Figure 2:
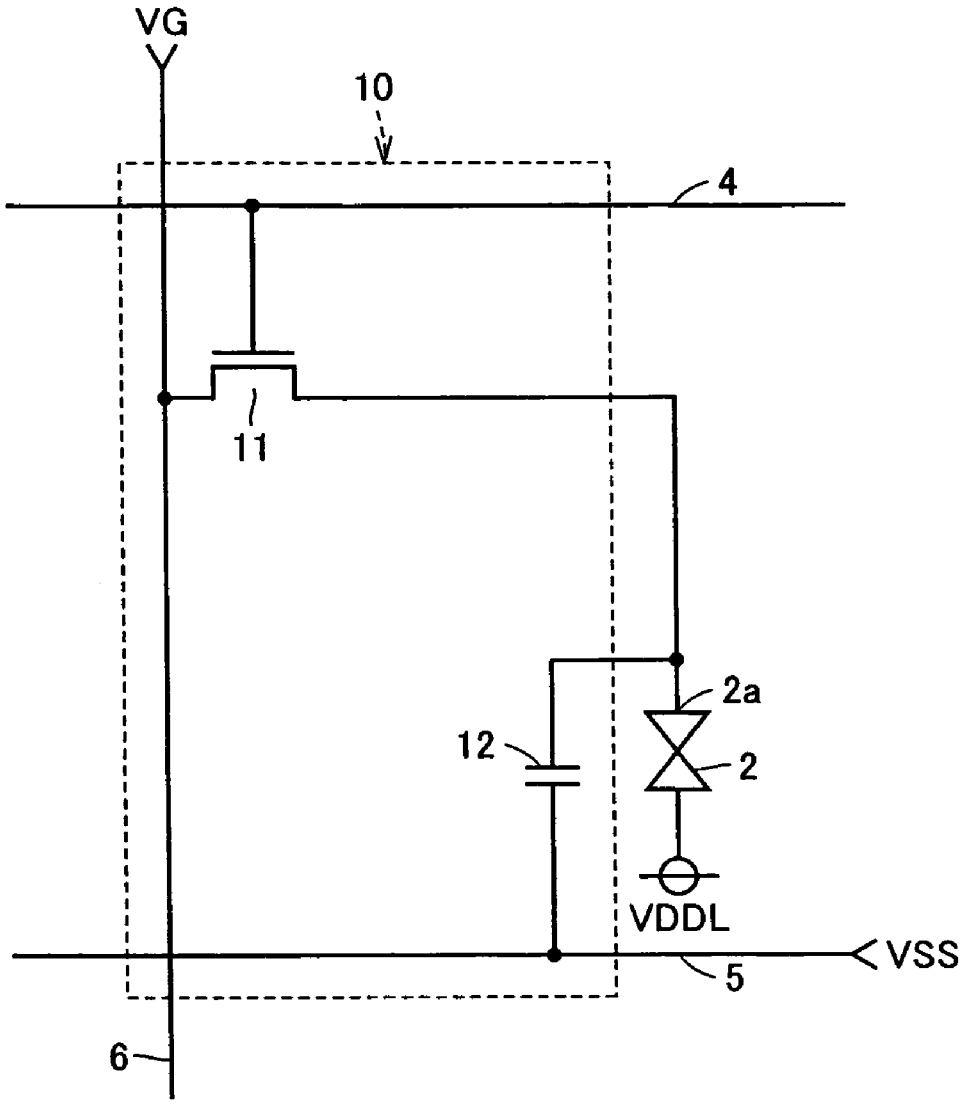
FIG. 2 is a circuit diagram showing a configuration of a liquid crystal driving circuit provided corresponding to a liquid crystal cell shown in FIG. 1.

As shown in FIG. 2, each liquid crystal cell 2 has a liquid crystal driving circuit 10. Liquid crystal driving circuit 10 includes an N-type field effect transistor (hereinafter, referred to as "N-type transistor") and a capacitor 12. N-type transistor 11 is connected between data line 6 and one electrode 2*a* of liquid crystal cell 2, and has its gate connected to scanning line 4. Capacitor 12 is connected between one electrode 2*a* of liquid crystal cell 2 and common potential line 5. The other electrode of liquid crystal cell 2 receives a driving potential VDDL, and common potential line 5 receives a common potential VSS.

Referring back to FIG. 1, vertical scanning circuit 7 successively selects a scanning line 4 from a plurality of scanning lines for a prescribed time period in accordance with an image signal, and sets selected scanning line 4 to "H" level, which is a selected level. When scanning line 4 is set to "H" level which is the selected level, N-type transistor 11 in FIG. 2 is rendered conductive, and one electrode 2*a* of each liquid crystal cell 2 corresponding to that scanning line 4 and data line 6 corresponding to that liquid crystal cell 2 are coupled.

Horizontal scanning circuit 8 successively selects a plurality of data lines 6, for example, 12 data lines, in accordance with the image signal while one scanning line 4 is selected by vertical scanning circuit 7, and provides a gradation potential to each of selected data lines 6. The light transmittance of liquid crystal cell 2 varies in accordance with a level of the gradation potential.

When all liquid crystal cells 2 in liquid crystal panel 1 are scanned by vertical scanning circuit 7 and horizontal scanning circuit 8, one image is displayed on liquid crystal panel 1.

Figure 3:
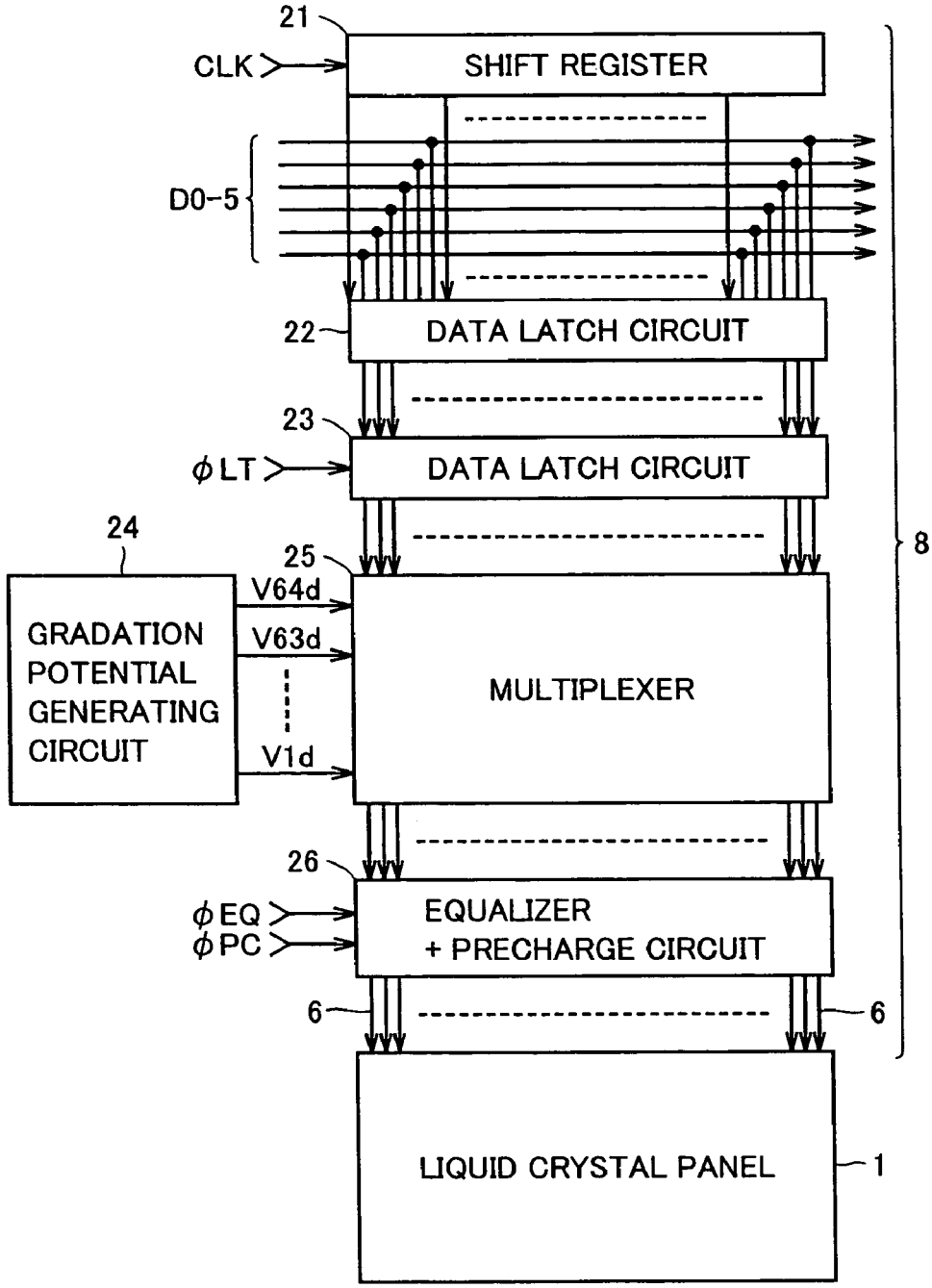
FIG. 3 is a block diagram showing a configuration of a horizontal scanning circuit shown in FIG. 1.

FIG. 3 is a block diagram showing a configuration of horizontal scanning circuit 8 shown in FIG. 1. In FIG. 3, horizontal scanning circuit 8 includes a shift register 21, data latch circuits 22, 23, a gradation potential generating circuit 24, a multiplexer 25, and an equalizer+precharge circuit 26.

Shift register 21 controls data latch circuit 22 in synchronization with a clock signal CLK. A video signal includes 6-bit data signals D0 to D5 serially input in synchronization with clock signal CLK. Accordingly, display in 260,000 colors is enabled in each pixel 3. Controlled by shift register 21, data latch circuit 22 successively takes in 6-bit data signals D0 to D5 included in the video signal. Data latch circuit 23, in response to a latch signal ϕLT, takes in a video signal of 1 line taken in data latch circuit 22 at a time.

Gradation potential generating circuit 24 generates 64 ($=2^6$) gradation potentials V1*d* to V64*d*. Equalizer+precharge circuit 26, in response to an equalization signal ϕEQ, connects a plurality of data lines 6 to each other so as to equalize the potentials of the plurality of data lines 6. In addition, in response to a precharge signal ϕPC, equalizer+precharge circuit 26 precharges each data line 6 to a precharge potential VPC. Multiplexer 25, corresponding to each data line 6, selects one potential out of 64 gradation potentials V1*d* to V64*d* from gradation potential generating circuit 24 in accordance with 6-bit data signals D0 to D5 from data latch circuit 23, and provides the selected potential to that data line 6.

Figure 4:
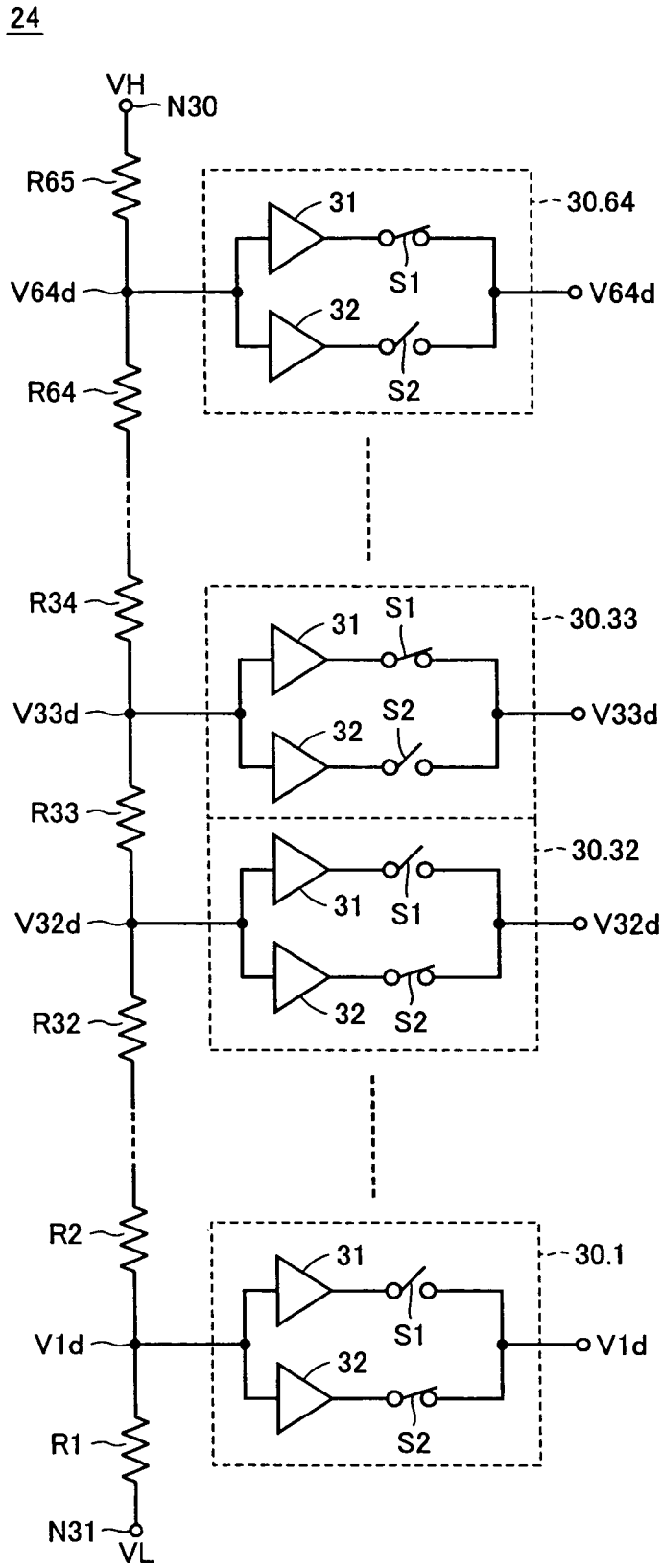
FIG. 4 is a circuit diagram showing a configuration of a gradation potential generating circuit shown in FIG. 3.

FIG. 4 is a circuit block diagram showing a configuration of gradation potential generating circuit 24 shown in FIG. 3. In FIG. 4, gradation potential generating circuit 24 includes resistance elements R1 to R65 and current amplifier circuits 30.1 to 30.64.

Resistance elements R1 to R65 connected in series between nodes N31 and N30 divide a voltage applied between nodes N31 and N30 to generate 64 gradation potentials V1*d* to V64*d*. Resistance elements R1 to R65 constitute a ladder resistance circuit. Normally, the liquid crystal driving voltage and the light transmittance of liquid crystal cell 2 are in a non-linear relation. Therefore, resistance values of resistance elements R1 to R65 are different from one another.

Since liquid crystal cell 2 should be alternately driven in a prescribed cycle (a cycle of 1 line, a cycle of 1 frame, etc.), the potential of node N30 and the potential of node N31 are alternately switched in a prescribed cycle. Driving potential VDDL in FIG. 2 is set to a potential equal to that of node N31. FIG. 4 shows a state in which high potential VH is provided to node N30 and low potential VL is provided to node N31.

Figure 5:
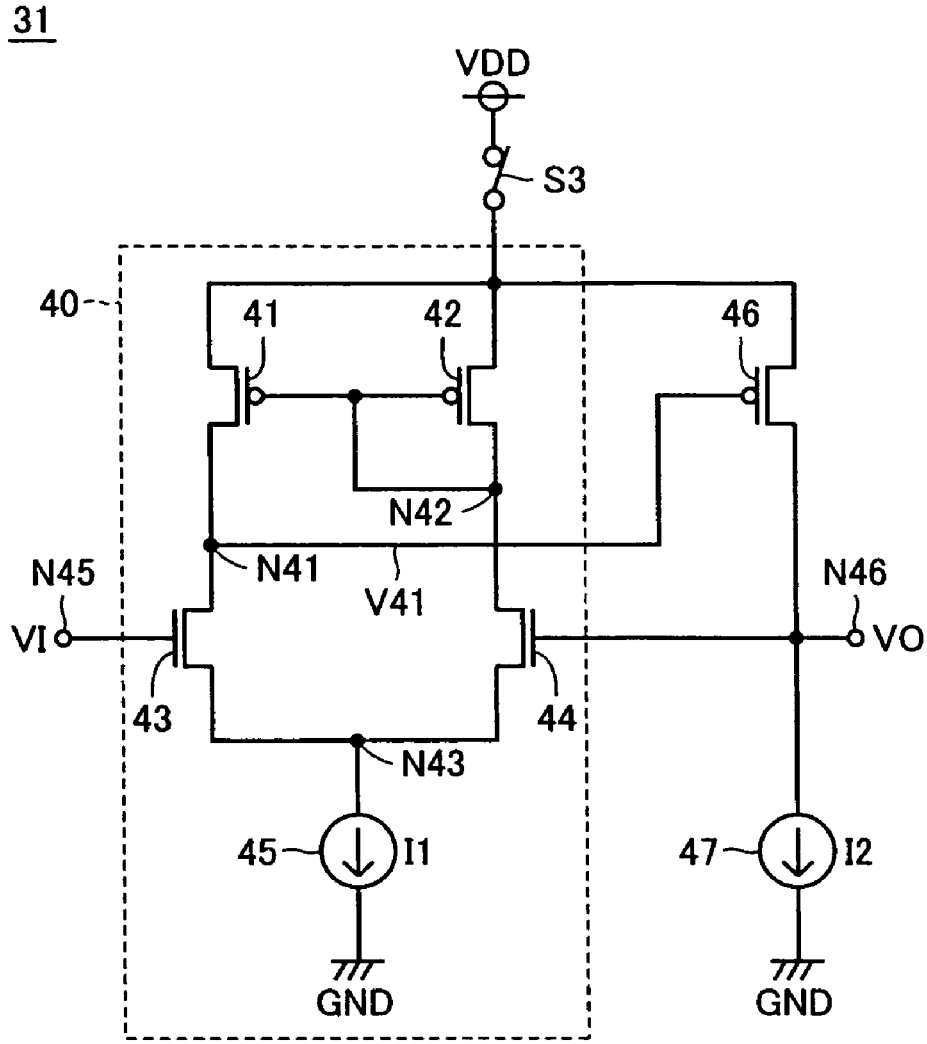
FIG. 5 is a circuit diagram showing a configuration of a push-type driving circuit shown in FIG. 4.

Current amplifier circuits 30.1 to 30.64 output potentials V1*d* to V64*d* of a level the same as 64 gradation potentials V1*d* to V64*d* respectively. Current amplifier circuit 30.1 includes a push-type driving circuit 31, a pull-type driving circuit 32, and switches S1, S2. As shown in FIG. 5, push-type driving circuit 31 includes a differential amplifier circuit 40, a switch S3, a P-type field effect transistor 46 (hereinafter, referred to as "P-type transistor"), and a constant current circuit 47. One terminal of switch S3 receives power supply potential VDD. Switch S3 is on/off-controlled in synchronization with potentials VH, VL of nodes N30, N31.

Differential amplifier circuit 40 includes P-type transistors 41, 42, N-type transistors 43, 44, and a constant current circuit 45. P-type transistors 41, 42 are connected between the other terminal of switch S3 and nodes N41, N42 respectively, and have their gates connected to node N42. P-type transistors 41, 42 constitute a current mirror circuit. N-type transistors 43, 44 are connected between nodes N41, N42 and node N43 respectively, and their gates receive potential VI (V1*d*) of an input node N45 and potential VO of an output node N46 respectively. Constant current circuit 45 causes a constant current I1 of a prescribed value to flow out from node N43 to a line of a ground potential GND. P-type transistor 46 is connected between the other terminal of switch S3 and output node N46, and its gate receives a potential V41 of node N41. Constant current circuit 47 causes a constant current I2 of a prescribed value to flow out from output node N46 to the line of ground potential GND. As the value of constant current I2 is set sufficiently small, the through current in driving circuit 31 is suppressed to a small value.

When switch S3 is turned off, push-type driving circuit 31 is not supplied with power supply potential VDD and does not consume power. When switch S3 is turned on, push-type driving circuit 31 is supplied with power supply potential VDD and activated. In N-type transistors 43, 44, currents having the values in accordance with input potential VI and output potential VO flow respectively. N-type transistor 44 and P-type transistor 42 are connected in series, and P-type transistors 41, 42 constitute the current mirror circuit. Therefore, a current having a value in accordance with output potential VO flows in P-type transistor 41.

When output potential VO is higher than input potential VI, the current flowing in P-type transistor 41 is larger than that flowing in N-type transistor 43 to raise potential V41 of node N41. In addition, the current flowing in P-type transistor 46 is reduced to lower output potential VO. When output potential VO is lower than input potential VI, the current flowing in P-type transistor 41 is smaller than that flowing in N-type transistor 43 to lower potential V41 of node N41. In addition, the current flowing in P-type transistor 46 is increased to raise output potential VO. Therefore, a relation of VO=VI is attained.

Figure 6:
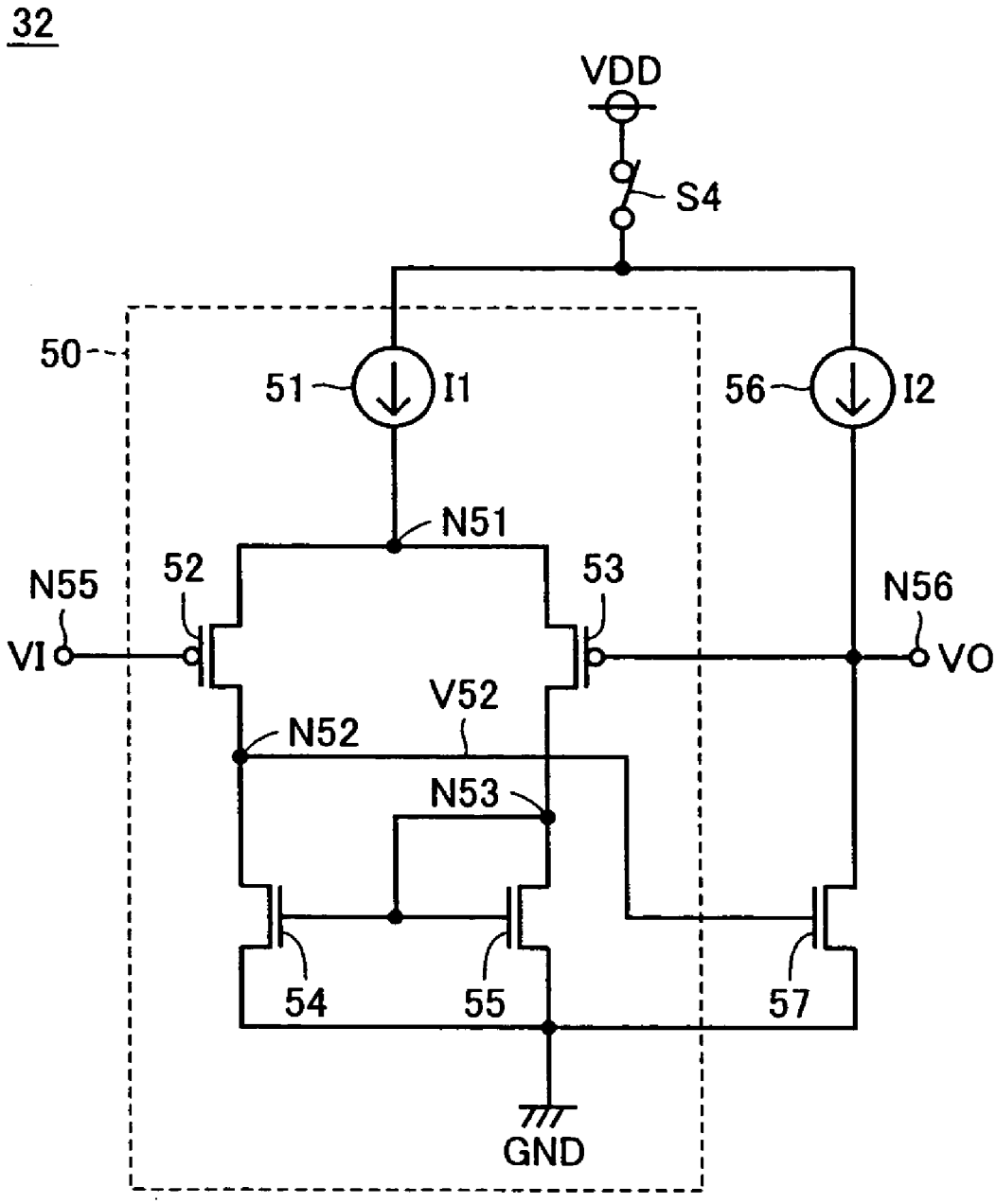
FIG. 6 is a circuit diagram showing a configuration of a pull-type driving circuit shown in FIG. 4.

As shown in FIG. 6, pull-type driving circuit 32 includes a differential amplifier circuit 50, a switch S4, a constant current circuit 56, and an N-type transistor 57. One terminal of switch S4 receives power supply potential VDD. Switch S4 is on/off-controlled in synchronization with potentials VH, VL of nodes N30, N31.

Differential amplifier circuit 50 includes a constant current circuit 51, P-type transistors 52, 53, and N-type transistors 54, 55. Constant current circuit 51 causes constant current I1 of a prescribed value to flow in from the other terminal of switch S4 to a node N51. P-type transistors 52, 53 are connected between node N51 and nodes N52, N53 respectively, and their gates receive potential VI (V1*d*) of an input node N55 and potential VO of an output node N56 respectively. N-type transistors 54, 55 are connected between nodes N52, N53 and a line of ground potential GND respectively, and have their gates connected to node N53. N-type transistors 54, 55 constitute a current mirror circuit. Constant current circuit 56 causes constant current I2 of a prescribed value to flow in from the other terminal of switch S4 to output node N56. N-type transistor 57 is connected between output node N56 and the line of ground potential GND, and its gate receives a potential V52 of node N52. As the value of constant current I2 is set sufficiently small, the through current in driving circuit 32 is suppressed to a small value.

When switch S4 is turned off, pull-type driving circuit 32 is not supplied with power supply potential VDD and does not consume power. When switch S4 is turned on, pull-type driving circuit 32 is supplied with power supply potential VDD and activated. In P-type transistors 52, 53, currents having values in accordance with input potential VI and output potential VO flow respectively. P-type transistor 53 and N-type transistor 55 are connected in series, and N-type transistors 54, 55 constitute the current mirror circuit. Therefore, a current having a value in accordance with output potential VO flows in N-type transistor 54.

When output potential VO is higher than input potential VI, the current flowing in N-type transistor 54 is smaller than that flowing in P-type transistor 52 to raise potential V52 of node N52. In addition, the current flowing in N-type transistor 57 is increased to lower output potential VO. When output potential VO is lower than input potential VI, the current flowing in N-type transistor 54 is larger than that flowing in P-type transistor 52 to lower potential V52 of node N52. In addition, the current flowing in N-type transistor 57 is reduced to raise output potential VO. Therefore, a relation of VO=VI is attained.

Referring back to FIG. 4, input nodes N45, N55 of driving circuits 31, 32 both receive gradation potential V1*d*, and output nodes N46, N56 thereof are connected to one terminals of switches S1, S2 respectively. The other terminals of switches S1, S2 are both connected to an output node of current amplifier circuit 30.1. Switches S1, S2 are turned on/off simultaneously with switches S3, S4 respectively. Other current amplifier circuits 30.2 to 30.64 are configured in a manner the same as in current amplifier circuit 30.1

As described later, before one potential out of gradation potentials V1*d* to V64*d* is applied to data line 6, data line 6 is precharged to a potential VPC=(VH+VL)/2 intermediate between high potential VH and low potential VL. Precharge potential VPC is a potential between V32*d* and V33*d*.

During a period in which high potential VH and low potential VL are applied to nodes N30, N31 respectively, switches S2, S4 of current amplifier circuits 30.1 to 30.32 are turned on, and output nodes thereof are lowered to gradation potentials V1*d* to V32*d* respectively. In addition, switches S1, S3 of current amplifier circuits 30.33 to 30.64 are turned on, and output nodes thereof are raised to gradation potentials V33*d* to V64*d* respectively. In this case, a relation of V64*d*>VPC>V1*d* is attained.

During a period in which low potential VL and high potential VH are applied to nodes N30, N31 respectively, switches S1, S3 of current amplifier circuits 30.1 to 30.32 are turned on, and output nodes thereof are raised to gradation potentials V1*d* to V32*d* respectively. In addition, switches S2, S4 of current amplifier circuits 30.33 to 30.64 are turned on, and output nodes thereof are lowered to gradation potentials V33*d* to V64*d* respectively. In this case, a relation of V64*d*<VPC<V1*d* is attained.

Figure 7:
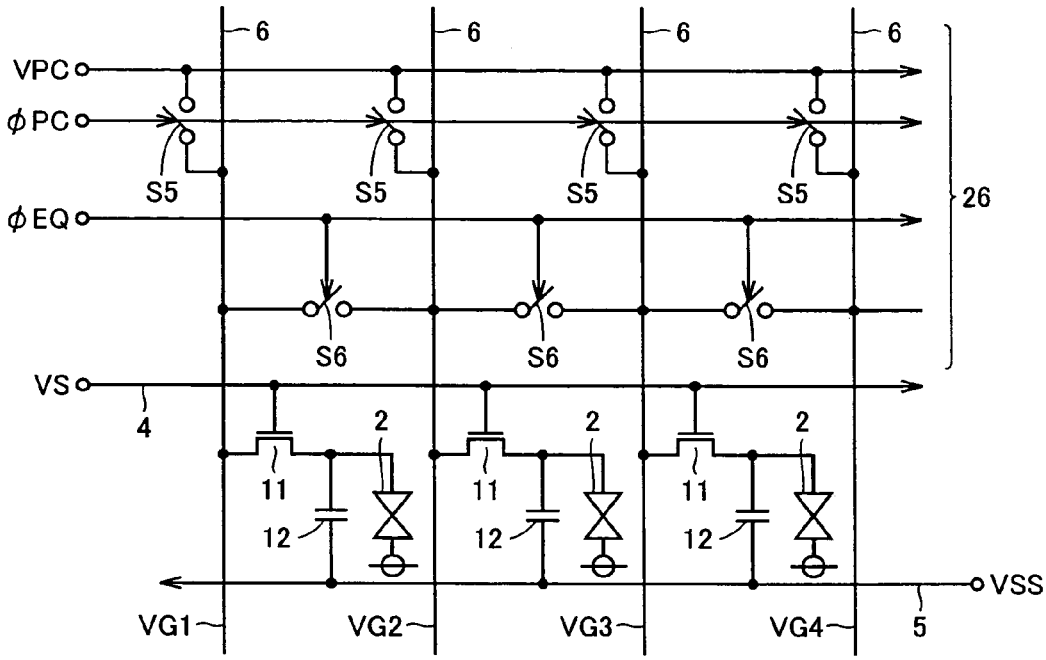
FIG. 7 is a circuit diagram showing a configuration of an equalizer+precharge circuit shown in FIG. 3.

FIG. 7 is a circuit diagram showing a configuration of equalizer+precharge circuit 26 shown in FIG. 3. In FIG. 7, equalizer+precharge circuit 26 includes switches S5 provided for each data line 6 and switches S6 provided corresponding to each adjacent two data lines 6. One terminal of switch S5 receives precharge potential VPC=(VH+VL)/2, and the other terminal thereof is connected to corresponding data line 6. Here, precharge potential VPC may be introduced from an external source, or generated internally. Switch S5 is turned on in response to precharge signal ϕPC attaining "H" level which is an activated level. When switch S5 is turned on, each data line 6 is set to precharge potential VPC. Switch S6 is connected between two data lines 6, and turned on in response to equalization signal ϕEQ attaining "H" level which is an activated level. When switch S6 is turned on, potentials VG1 to VGn of n data lines 6 (n is an integer not smaller than 2) are averaged.

Figure 8:
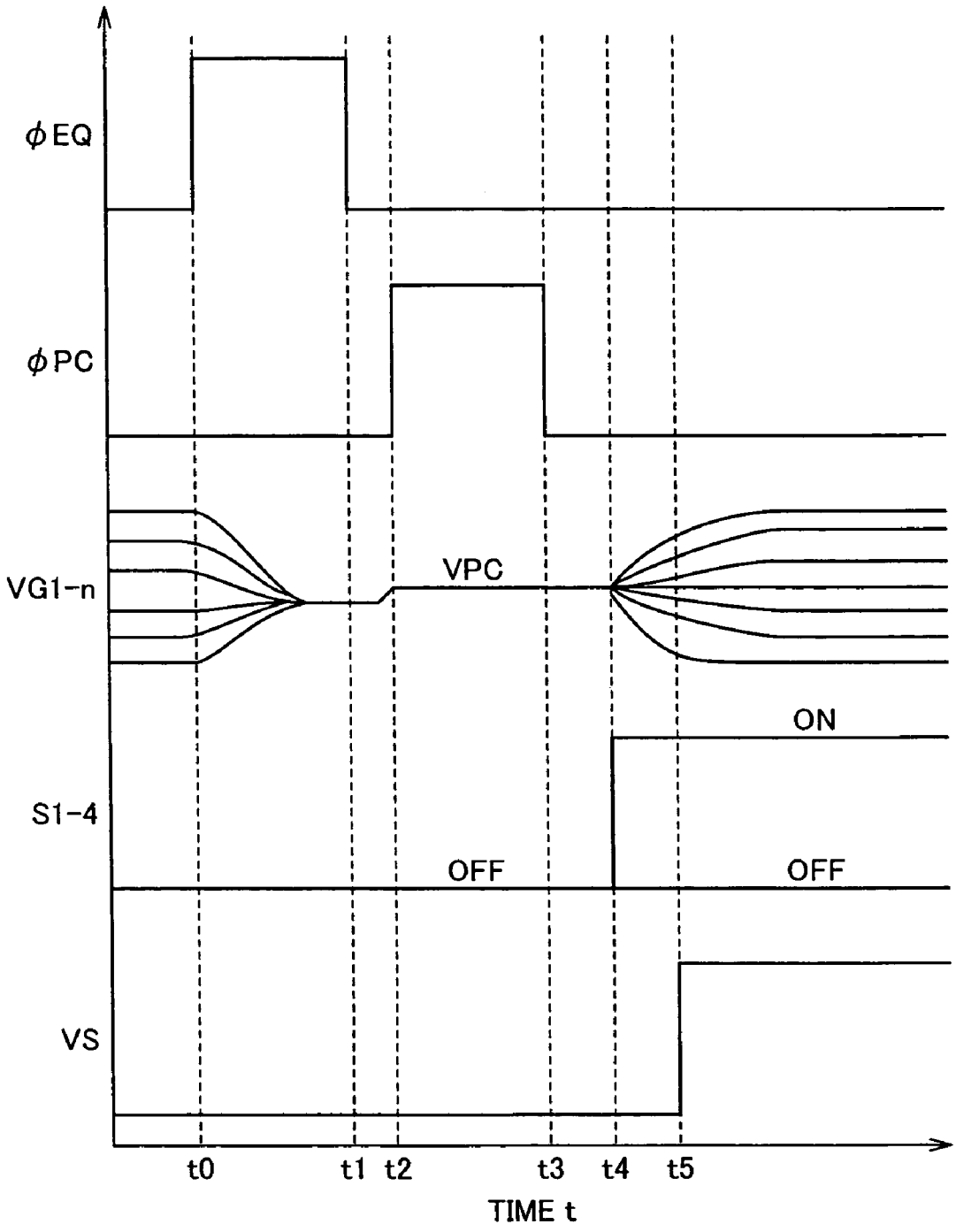
FIG. 8 is a circuit diagram showing an operation of the color liquid crystal display device shown in FIGS. 1 to 7.

FIG. 8 is a time chart showing an operation of the color liquid crystal display device shown in FIGS. 1 to 7. In FIG. 8, at an initial state, equalization signal ϕEQ and precharge signal ϕPC are set to "L" level which is an inactivated level, and switches S1 to S6 are turned off. Here, each of potentials VG1 to VGn of n data lines 6 is set to a potential written in a previous cycle, that is, one potential out of V1*d* to V64*d*. In addition, a potential VS of scanning line 4 is set to "L" level, and N-type transistor 11 is non-conductive.

When equalization signal ϕEQ is set to "H" level which is an activated level at time t0, each switch S6 is turned on and n data lines 6 are short-circuited to one another. Potentials VG1 to VGn of n data lines 6 are thus averaged. Here, the potential of each data line 6 is determined by potentials VG1 to VGn of n data lines 6 at time t0, and does not attain a constant value. When equalization signal ϕEQ is set to "L" level which is an inactivated level at time t1, each switch S6 is turned off and n data lines 6 are electrically isolated from one another.

Then, when precharge signal ϕPC is set to "H" level which is an activated level at time t2, each switch S5 is turned on and each data line 6 is set to precharge potential VPC. When a precharge signal ϕP1 is set to "L" level which is an activated level at time t3, each switch S5 is turned off and n data lines 6 are electrically isolated from one another.

At time t4, high potential VH and low potential VL are applied to nodes N30, N31 respectively, for example. Then, switches S1, S3 of current amplifier circuits 30.33 to 30.64 are turned on, and switches S2, S4 of current amplifier circuits 30.1 to 30.32 are turned on. Each of potentials VG1 to VGn of n data lines 6 is varied toward the output potential of driving circuit 31 or 32 connected by multiplexer 25.

Here, data line 6 connected to one of current amplifier circuits 30.33 to 30.64 is rapidly charged by P-type transistor 46 in push-type driving circuit 31, and data line 6 connected to one of current amplifier circuits 30.1 to 30.32 is rapidly discharged by N-type transistor 57 in pull-type driving circuit 32.

At time t5, potential VS of one scanning line 4 rises to "H" level which is the selected level. Hence, each N-type transistor 11 in FIG. 7 is rendered conductive, and potential VG of each data line 6 is provided to liquid crystal cell 2 through N-type transistor 11. When potential VG of scanning line 4 falls to "L" level, N-type transistor 11 is rendered non-conductive, and an interelectrode voltage of liquid crystal cell 2 is held by capacitor 12. Liquid crystal cell 2 exhibits light transmittance in accordance with the interelectrode voltage.

In Embodiment 1, push-type driving circuit 31, pull-type driving circuit 32 and switches S1, S2 are provided in each of current amplifier circuits 30.1 to 30.64. In the current amplifier circuit outputting a potential higher than precharge potential VPC (30.33 to 30.64 in FIG. 4), switch S1 is turned on and solely push-type driving circuit 31 is used. In the current amplifier circuit outputting a potential lower than precharge potential VPC (30.1 to 30.32 in FIG. 4), switch S2 is turned on and solely pull-type driving circuit 32 is used. In addition, in driving circuits 31, 32 not connected to data line 6, switches S3, S4 are turned off and supply of power supply potential VDD is stopped. Therefore, the through current in current amplifier circuits 30.1 to 30.64 is minimized and power consumption can be lowered.

Here, each of field effect transistors 11, 41 to 44, 46, 52 to 55, and 57 may be an MOS transistor or a thin film transistor (TFT). The thin film transistor may be formed with a semiconductor film such as a polysilicon film, an amorphous silicon film or the like, or may be formed on an insulating substrate such as a resin substrate, a glass substrate or the like.

Figure 9:
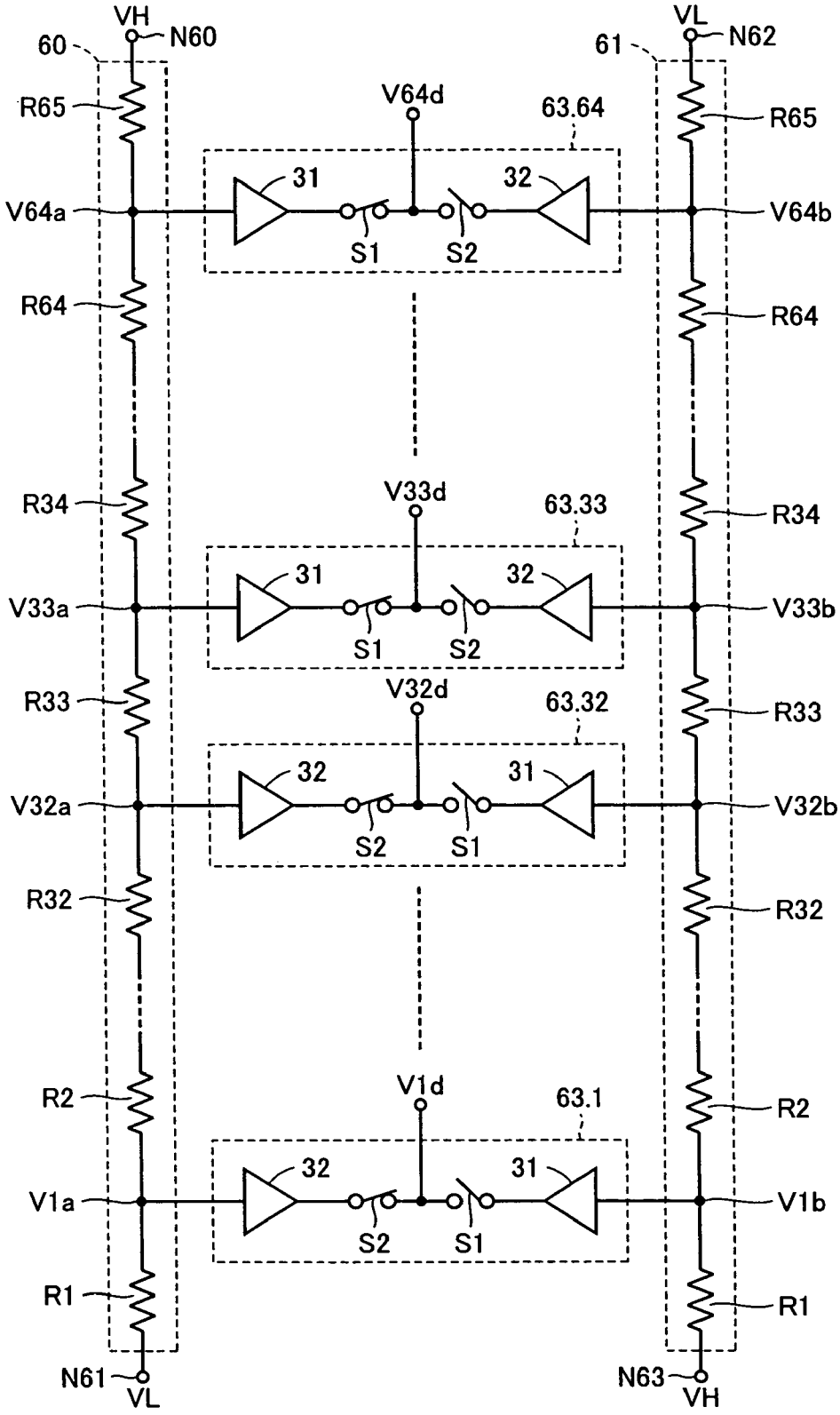
FIG. 9 is a circuit diagram showing a variation of Embodiment 1.

FIG. 9 is a circuit diagram showing a gradation potential generating circuit in a color liquid crystal display device in a variation of Embodiment 1, and shown in contrast to FIG. 4. In FIG. 9, the gradation potential generating circuit includes two pairs of ladder resistance circuits 60, 61 and 64 current amplifier circuits 63.1 to 63.64. Ladder resistance circuit 60 includes resistance elements R1 to R65 connected in series between nodes N61 and N60. High potential VH and low potential VL are always applied to nodes N60 and N61 respectively. Ladder resistance circuit 60 generates 64 gradation potentials V1*a* to V64*a* (V64*a*>V1*a*). The ladder resistance circuit 61 includes resistance elements R1 to R65 connected in series between nodes N63 and N62. Low potential VL and high potential VH are always applied to nodes N62 and N63 respectively. Ladder resistance circuit 61 generates 64 gradation potentials V1*b* to V64*b* (V64*b*>V1*b*).

Each of current amplifier circuits 63.1 to 63.64 includes push-type driving circuit 31, pull-type driving circuit 32, and switches S1, S2 shown in FIGS. 4 to 6. Input nodes of push-type driving circuit 31 in current amplifier circuits 63.33 to 63.64 receive output potentials V33*a* to V64*a* of ladder resistance circuit 60 respectively, and input nodes of pull-type driving circuit 32 in current amplifier circuits 63.1 to 63.32 receive output potentials V1*a* to V32*a* of ladder resistance circuit 60. Input nodes of pull-type driving circuit 32 in current amplifier circuits 63.33 to 63.64 receive output potentials V33*b* to V64*b* of ladder resistance circuit 61 respectively, and input nodes of push-type driving circuit 31 of current amplifier circuits 63.1 to 63.32 receive output potentials V1*b* to V32*b* of ladder resistance circuit 61. An output node of each push-type driving circuit 31 is connected to an output node of corresponding current amplifier circuit through switch S1, and an output node of each pull-type driving circuit 32 is connected to an output node of corresponding current amplifier circuit through switch S2.

Switches S1 to S4 operate at a timing described with reference to FIGS. 4 to 6. In a certain cycle, as shown in FIG. 9, switches S1, S3 of current amplifier circuits 63.33 to 63.64 are turned on, and switches S2, S4 of current amplifier circuits 63.1 to 63.32 are turned on. That is, a relation of V64*d*>VPC>V1*d* is attained. In a next cycle, switches S2, S4 of current amplifier circuits 63.33 to 63.64 are turned on, and switches S1, S3 of current amplifier circuits 63.1 to 63.32 are turned on. Here, a relation of V1*d*>VPC>V64*d* is attained. In this variation as well, an effect the same as in Embodiment 1 can be obtained.

Figure 10:
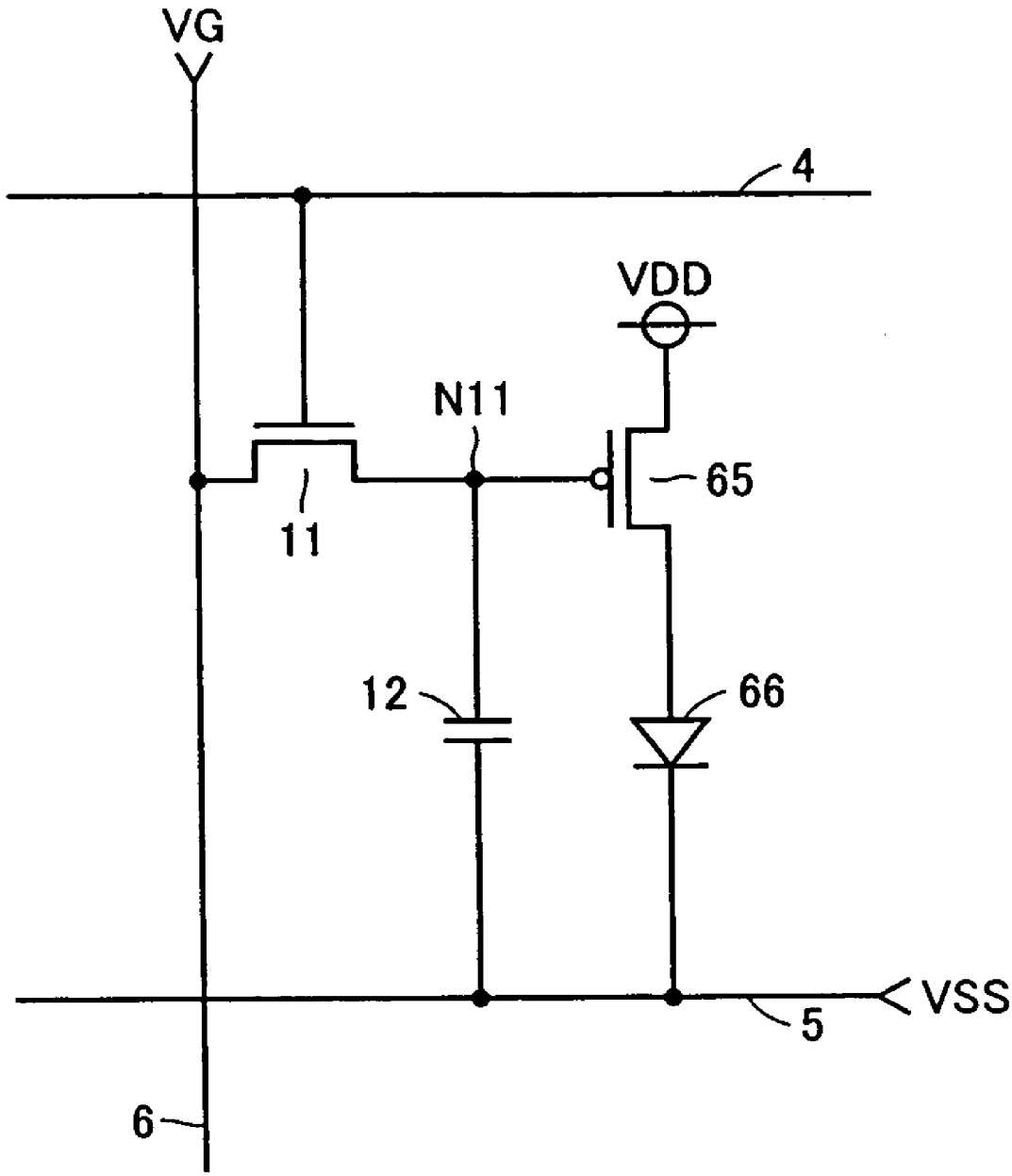
FIG. 10 is a circuit diagram showing another variation of Embodiment 1.

FIG. 10 is a circuit diagram showing a main portion of an image display device in the variation of Embodiment 1, and shown in contrast to FIG. 2. In this variation in FIG. 10, liquid crystal cell 2 in FIG. 2 is replaced with a P-type transistor 65 and an EL (electroluminescence) element 66. P-type transistor 65 and EL element 66 are connected in series between a line of power supply potential VDD and common potential line 5, and the gate of P-type transistor 65 is connected to node N11 between N-type transistor 11 and capacitor 12. When a gradation potential is provided to node N11, a current of a value in accordance with that gradation potential flows in P-type transistor 65, and EL element 66 emits light having intensity in accordance with the current value. In EL element 66, polarity of the applied voltage does not need to be switched as in liquid crystal cell 2. Therefore, in gradation potential generating circuit 24 in FIG. 24, nodes N30, N31 are fixed to high potential VH and low potential VL respectively, current amplifier circuits 30.1 to 30.32 include solely pull-type driving circuit 32, and current amplifier circuits 30.33 to 30.64 include solely push-type driving circuit 31. In this variation as well, an effect the same as in Embodiment 1 can be obtained.

Embodiment 2

In push-type driving circuit 31 in FIG. 5, output potential VO is directly fed back to differential amplifier circuit 40 and load capacity is large, leading to oscillation phenomenon. In Embodiment 2, this problem will be solved.

Figure 11:
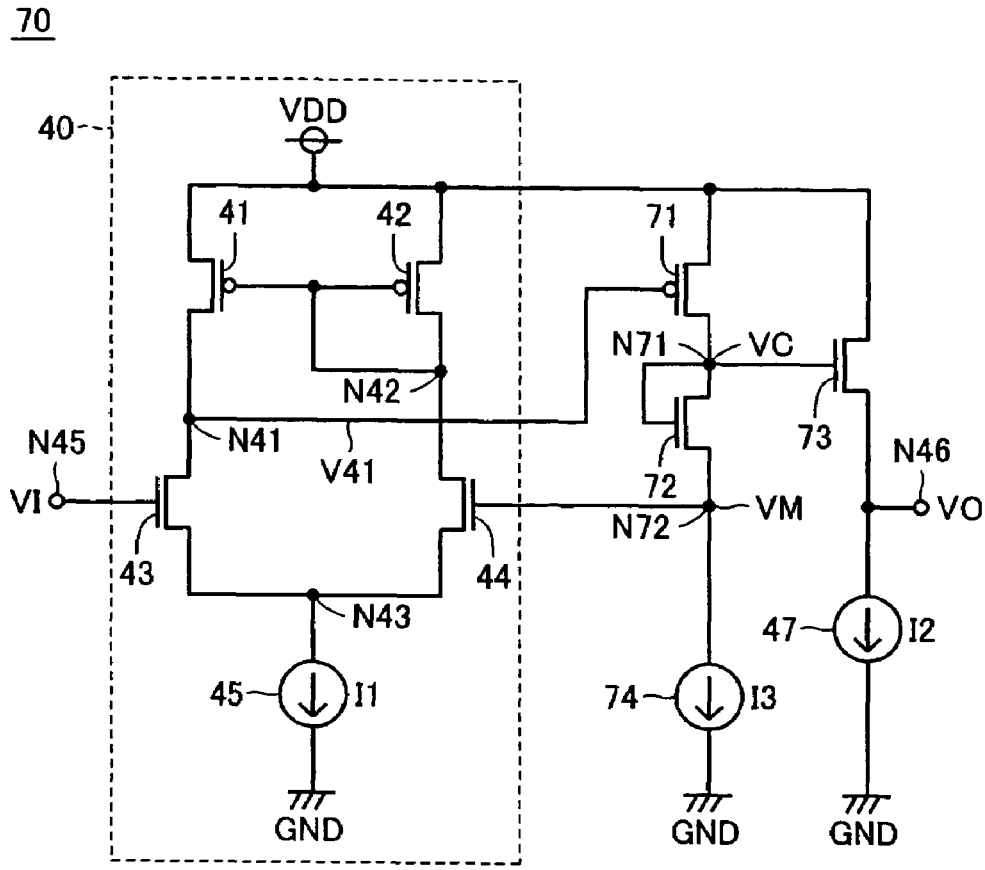
FIG. 11 is a circuit diagram showing a configuration of a push-type driving circuit in Embodiment 2 of the present invention.

FIG. 11 is a circuit diagram showing a configuration of a push-type driving circuit 70 in Embodiment 2 of the present invention. In FIG. 11, push-type driving circuit 70 is obtained by replacing P-type transistor 46 of push-type driving circuit 31 in FIG. 5 with a P-type transistor 71, N-type transistors 72, 73, and a constant current circuit 74. For the sake of simplicity of description and drawings, switches S3, S4 for supplying power to the driving circuit will not be shown hereinafter.

P-type transistor 71, N-type transistor 72 and constant current circuit 74 are connected in series between a line of power supply potential VDD and a line of ground potential GND. The gate of P-type transistor 71 receives potential V41 of output node N41 of differential amplifier circuit 40. The gate of N-type transistor 72 is connected to its drain. N-type transistor 72 implements a diode element. A potential VM of the source (node N72) of N-type transistor 72 is provided to the gate of N-type transistor 44. Constant current circuit 72 causes a constant current I3 to flow out from node N72 to the line of ground potential GND. N-type transistor 73 is connected between the line of power supply potential VDD and output node N46, and its gate receives a potential VC of a node N71 between transistor 71 and 72.

An operation of driving circuit 70 will now be described. In driving circuit 70, potential VM of node N72 is set equal to potential VI of input node N45, by an operation of differential amplifier circuit 40. In other words, as N-type transistor 44 and P-type transistor 42 are connected in series and P-type transistors 41 and 42 constitute a current mirror circuit, a current of a value in accordance with a monitor potential VM flows in P-type transistor 41.

When monitor potential VM is higher than input potential VI, the current flowing in P-type transistor 41 is larger than that flowing in N-type transistor 43 and potential V41 of node N41 is raised. In addition, the current flowing in P-type transistor 71 is reduced to lower monitor potential VM. When monitor potential VM is lower than input potential VI, the current flowing in P-type transistor 41 is smaller than that flowing in N-type transistor 43 and potential V41 of node N41 is lowered. In this manner, the current flowing in P-type transistor 71 is increased to raise monitor potential VM. Therefore, a relation of VM=VI is attained.

As current I3 of constant current circuit 74 is set to a small value, potential VC of node N71 is VC=VM+VTN. Here, VTN refers to a threshold voltage of the N-type transistor. If current drivability of N-type transistor 73 is sufficiently enhanced as. compared with that of constant current circuit 47, N-type transistor 73 performs a source follower operation, and potential VO of output node N46 is VO=VC−VTN=VM=VI. Therefore, output potential VO equal to input potential VI is obtained.

In Embodiment 2, a capacity of a feedback loop to differential amplifier circuit 40 serves as a gate capacity of N-type transistors 44, 72, 73. Therefore, the capacity of the feedback loop to differential amplifier circuit 40 is made sufficiently smaller than in driving circuit 31 in FIG. 5 in which load capacity is directly connected to differential amplifier circuit 40. Accordingly, oscillation phenomenon will not take place in driving circuit 70.

Figure 12A:
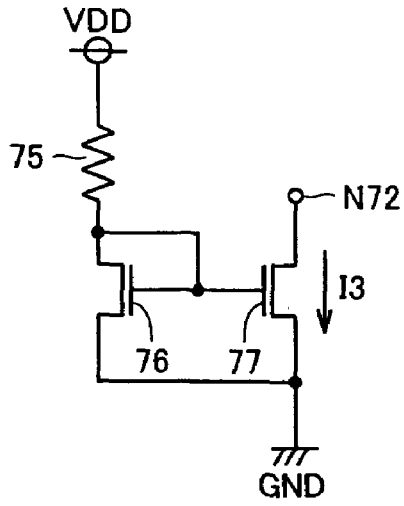
FIGS. 12A to 12C are circuit diagrams each illustrating a configuration of a constant current circuit shown in FIG. 11.
Figure 12B:
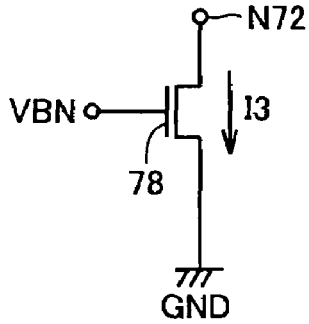
Figure 12C:
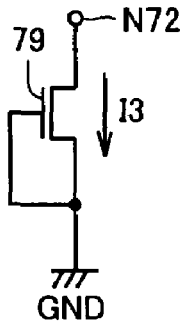

FIGS. 12A to 12C are circuit diagrams each illustrating a configuration of constant current circuit 74 shown in FIG. 11. In FIG. 12A, constant current circuit 74 includes a resistance element 75 and N-type transistors 76, 77. Resistance element 75 and N-type transistor 76 are connected in series between the line of power supply potential VDD and the line of ground potential GND, and N-type transistor 77 is connected between node N72 and the line of ground potential GND. The gates of N-type transistors 76, 77 are both connected to the drain of N-type transistor 76. N-type transistors 76, 77 constitute a current mirror circuit. A constant current of a value in accordance with a resistance value of resistance element 75 flows in resistance element 75 and N-type transistor 76. Constant current I3 of a value in accordance with the current flowing in N-type transistor 76 flows in N-type transistor 77.

In FIG. 12B, constant current circuit 74 includes an N-type transistor 78. N-type transistor 78 is connected between node N72 and the line of ground potential GND, and its gate receives a constant bias potential VBN. Bias potential VBN is set to such a prescribed level that N-type transistor 78 operates in a saturation region. Thus, constant current I3 flows in N-type transistor 78.

In FIG. 12C, constant current circuit 74 includes a depression-type N-type transistor 79. N-type transistor 79 is connected between node N72 and the line of ground potential GND, and its gate is connected to the line of ground potential GND. N-type transistor 79 is formed so as to flow constant current I3 even when a gate-source voltage is at 0V. Here, constant current circuit 74 may be formed with a resistance element connected between node N72 and the line of ground potential GND. Each constant current circuit 45, 47 may have a configuration the same as that of constant current circuit 74.

Figure 13:
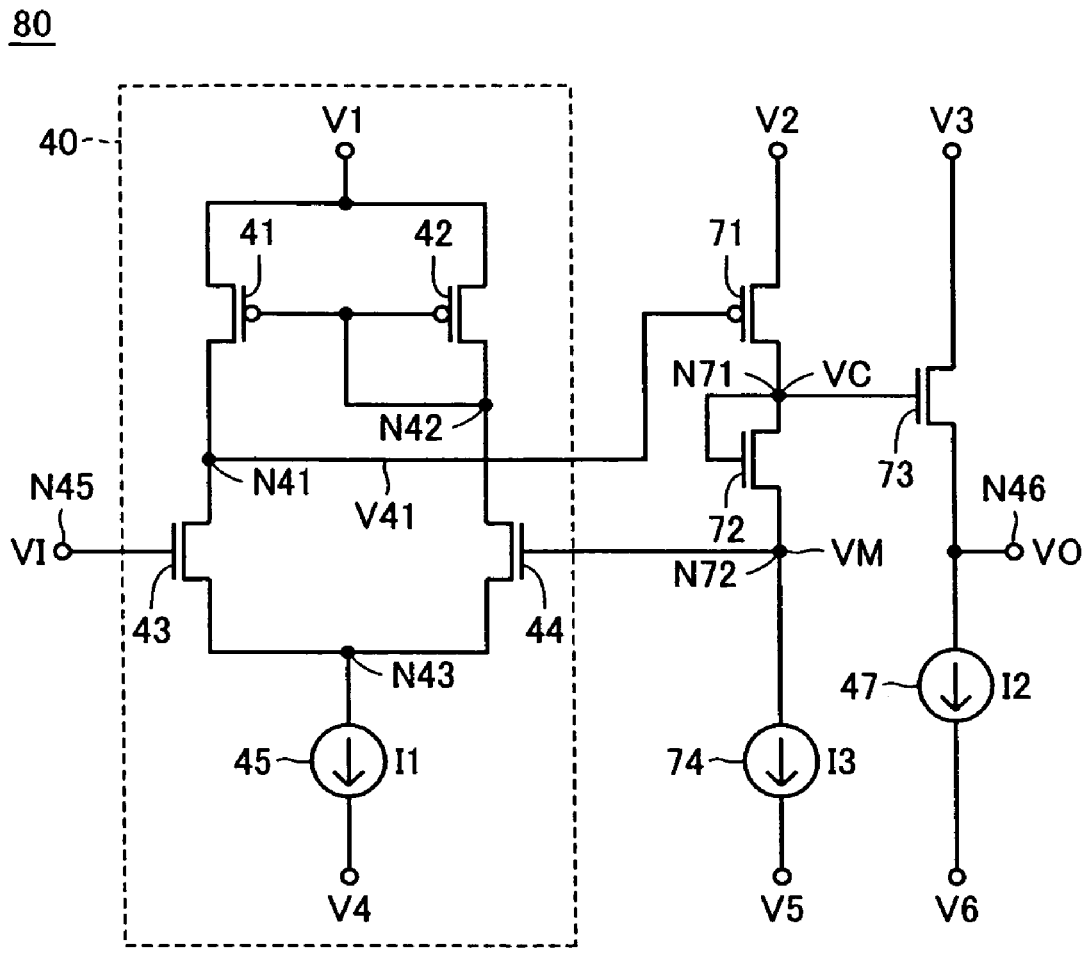
FIG. 13 is a circuit diagram showing a variation of Embodiment 2.

In a driving circuit 80 in FIG. 13, the sources of P-type transistors 41, 42, the source of P-type transistor 71, and the drain of N-type transistor 73 are provided with power supply potentials V1, V2, V3 different from one another. In addition, terminals on the lower potential side of constant current circuits 45, 74, 47 are connected to power supply potentials V4, V5, V6 different from one another. In this variation as well, an effect the same as in driving circuit 70 in FIG. 11 can be obtained.

Figure 14:
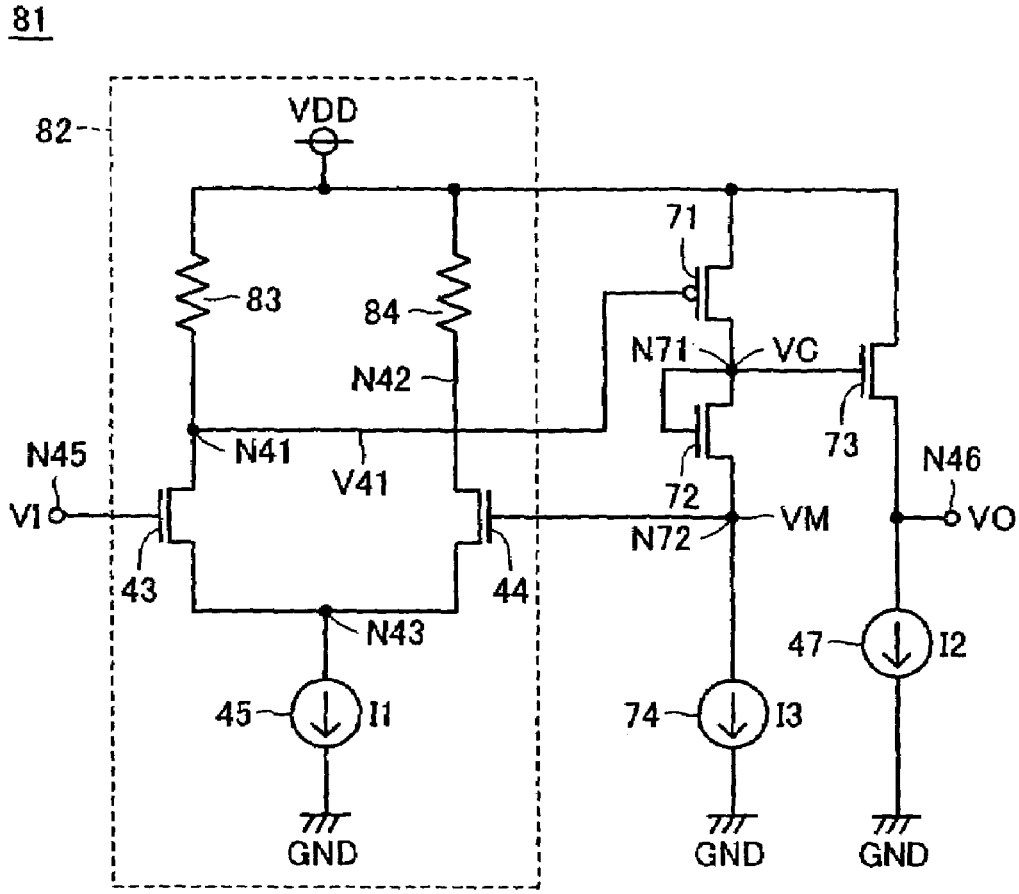
FIG. 14 is a circuit diagram showing another variation of Embodiment 2.

A driving circuit 81 in FIG. 14 is obtained by replacing differential amplifier circuit 40 in driving circuit 70 in FIG. 11 with a differential amplifier circuit 82. Differential amplifier circuit 82 is obtained by replacing P-type transistors 41, 42 in differential amplifier circuit 40 with resistance elements 83, 84.respectively. Resistance elements 83, 84 are connected between the line of power supply potential VDD and nodes N41, N42 respectively.

The total of the current flowing in N-type transistor 43 and the current flowing in N-type transistor 44 is equal to current I1 flowing in constant current circuit 45. When monitor potential VM is equal to input potential VI, the current flowing in N-type transistor 43 is equal to the current flowing in N-type transistor 44. If monitor potential VM is higher than input potential VI, the current flowing in N-type transistor 44 is increased and the current flowing in N-type transistor 43 is decreased. In addition, potential V41 of node N41 rises and the current flowing in P-type transistor 71 is decreased, so as to lower monitor potential VM. If monitor potential VM is lower than input potential VI, the current flowing in N-type transistor 44 is decreased and the current flowing in N-type transistor 43 is increased. In addition, potential V41 of node N41 is lowered and the current flowing in P-type transistor 71 is increased, so as to raise monitor potential VM. Therefore, monitor potential VM is held at a level the same as input potential VI, and a relation of VO=VI is attained. In this variation as well, an effect the same as in driving circuit 70 in FIG. 11 can be obtained.

Embodiment 3

Figure 15:
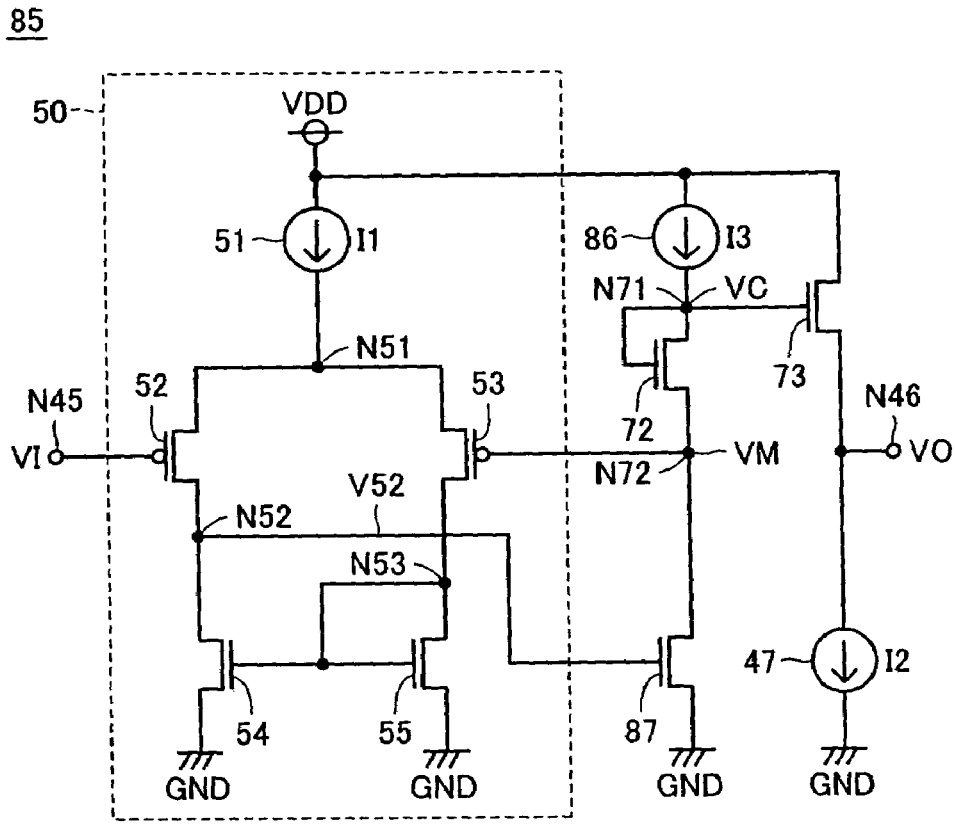
FIG. 15 is a circuit diagram showing a configuration of a push-type driving circuit in Embodiment 3 of the present invention.

FIG. 15 is a circuit diagram showing a configuration of a push-type driving circuit 85 in Embodiment 3 of the present invention. In FIG. 15, driving circuit 85 is obtained by replacing differential amplifier circuit 40 in driving circuit 80 in FIG. 11 with differential amplifier circuit 50 in FIG. 6 and replacing P-type transistor 71 and constant current circuit 74 with a constant current circuit 86 and an N-type transistor 87 respectively. Constant current circuit 86 is connected between the line of power supply potential VDD and node N71, and causes constant current I3 of a prescribed value to flow in from the line of power supply potential VDD to node N71. N-type transistor 87 is connected between node N72 and the line of ground potential GND, and its gate receives potential V52 of output node N52 of differential amplifier circuit 50.

An operation of driving circuit 85 will now be described. In driving circuit 85, monitor potential VM is set equal to potential VI by an operation of differential amplifier circuit 50. In other words, as P-type transistor 53 and N-type transistor 55 are connected in series and N-type transistors 54 and 55 constitute a current mirror circuit, a current of a value in accordance with monitor potential VM flows in N-type transistor 54.

When monitor potential VM is higher than input potential VI, the current flowing in N-type transistor 54 is smaller than that flowing in P-type transistor 52 and potential V52 of node N52 is raised. Then, the current flowing in N-type transistor 87 is increased to lower monitor potential VM. When monitor potential VM is lower than input potential VI, the current flowing in N-type transistor 54 is larger than that flowing in P-type transistor 52 and potential V52 of node N52 is lowered. Then, the current flowing in N-type transistor 87 is decreased to raise monitor potential VM. Therefore, a relation of VM=VI is attained.

As current I3 of constant current circuit 86 is set to a sufficiently small value, potential VC of node N71 is VC=VM+VTN. If current drivability of N-type transistor 73 is sufficiently enhanced as compared with that of constant current circuit 47, N-type transistor 73 performs a source follower operation, and potential VO of output node N46 is VO=VC−VTN=VM=VI. Therefore, output potential VO of a level equal to input potential VI is obtained.

In Embodiment 3, a capacity of a feedback loop to differential amplifier circuit 50 serves as a gate capacity of transistors 53, 72, 73. Therefore, the capacity of the feedback loop to differential amplifier circuit 50 is made sufficiently small, as compared with driving circuit 31 in FIG. 5 in which load capacity is directly connected to differential amplifier circuit 40. Accordingly, an oscillation phenomenon will not take place in driving circuit 85.

Figure 16A:
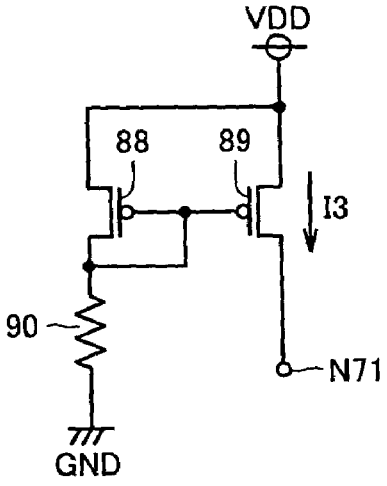
FIGS. 16A to 16C are circuit diagrams each illustrating a configuration of a constant current circuit shown in FIG. 15.
Figure 16B:
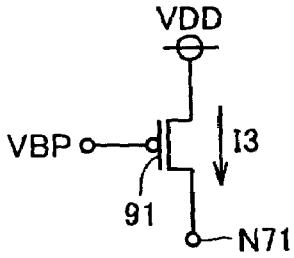
Figure 16C:
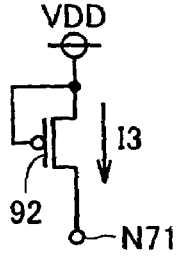

FIGS. 16A to 16C are circuit diagrams each illustrating a configuration of a constant current circuit 86 shown in FIG.

15. In FIG. 16A, constant current circuit 86 includes P-type transistors 88, 89 and a resistance element 90. P-type transistor 88 and resistance element 90 are connected in series between the line of power supply potential VDD and the line of ground potential GND, and P-type transistor 89 is connected between the line of power supply potential VDD and node N71. The gates of P-type transistors 88, 89 are both connected to the drain of P-type transistor 88. P-type transistors 88, 89 constitute a current mirror circuit. A constant current of a value in accordance with a resistance value of resistance element 90 flows in P-type transistor 88 and resistance element 89. Constant current I3 of a value in accordance with the current flowing in P-type transistor 88 flows in P-type transistor 89.

In FIG. 16B, constant current circuit 86 includes a P-type transistor 91. P-type transistor 91 is connected between the line of power supply potential VDD and node N71, and its gate receives a constant bias potential VBP. Bias potential VBP is set to such a prescribed level that P-type transistor 91 operates in a saturation region. Thus, constant current I3 flows in P-type transistor 91.

In FIG. 16C, constant current circuit 86 includes a depression-type P-type transistor 92. P-type transistor 92 is connected between the line of power supply potential VDD and node N71, and its gate is connected to the line of power supply potential VDD. P-type transistor 92 is formed such that constant current I3 flows even when a gate-source voltage is at 0V. Here, constant current circuit 86 may be formed with a resistance element connected between the line of power supply potential VDD and node N71. Constant current circuit 51 may have a configuration the same as that of constant current circuit 86.

Figure 17:
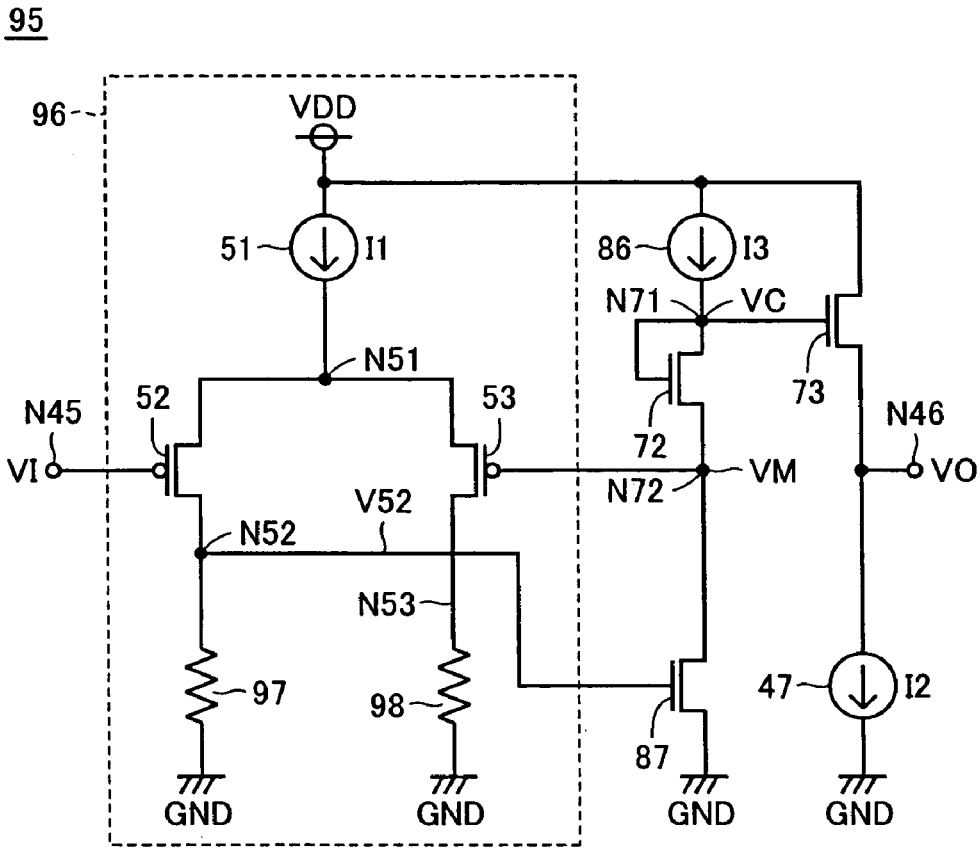
FIG. 17 is a circuit diagram showing a variation of Embodiment 3.

A driving circuit 95 in FIG. 17 is obtained by replacing differential amplifier circuit 50 in driving circuit 85 in FIG. 15 with a differential amplifier circuit 96. Differential amplifier circuit 96 is obtained by replacing N-type transistors 54, 55 in differential amplifier circuit 50 with resistance elements 97, 98. Resistance elements 97, 98 are connected between nodes N52, N53 and the line of ground potential GND respectively. The total of the current flowing in P-type transistor 52 and the current flowing in P-type transistor 53 is equal to current I1 flowing in constant current circuit 51. When monitor potential VM is equal to input potential VI, the current flowing in P-type transistor 52 is equal to the current flowing in P-type transistor 53. If monitor potential VM is higher than input potential VI, the current flowing in P-type transistor 53 is decreased and the current flowing in P-type transistor 52 is increased. Then, potential V52 of node N52 rises and the current flowing in N-type transistor 87 is increased, so as to lower monitor potential VM. If monitor potential VM is lower than input potential VI, the current flowing in P-type transistor 53 is increased and the current flowing in P-type transistor 52 is decreased. Then, potential V52 of node N52 is lowered and the current flowing in N-type transistor 87 is decreased, so as to raise monitor potential VM. Therefore, monitor potential VM is held at input potential VI, and VO=VI is attained. In this variation as well, an effect the same as in driving circuit 85 in FIG. 15 can be obtained.

Figure 18:
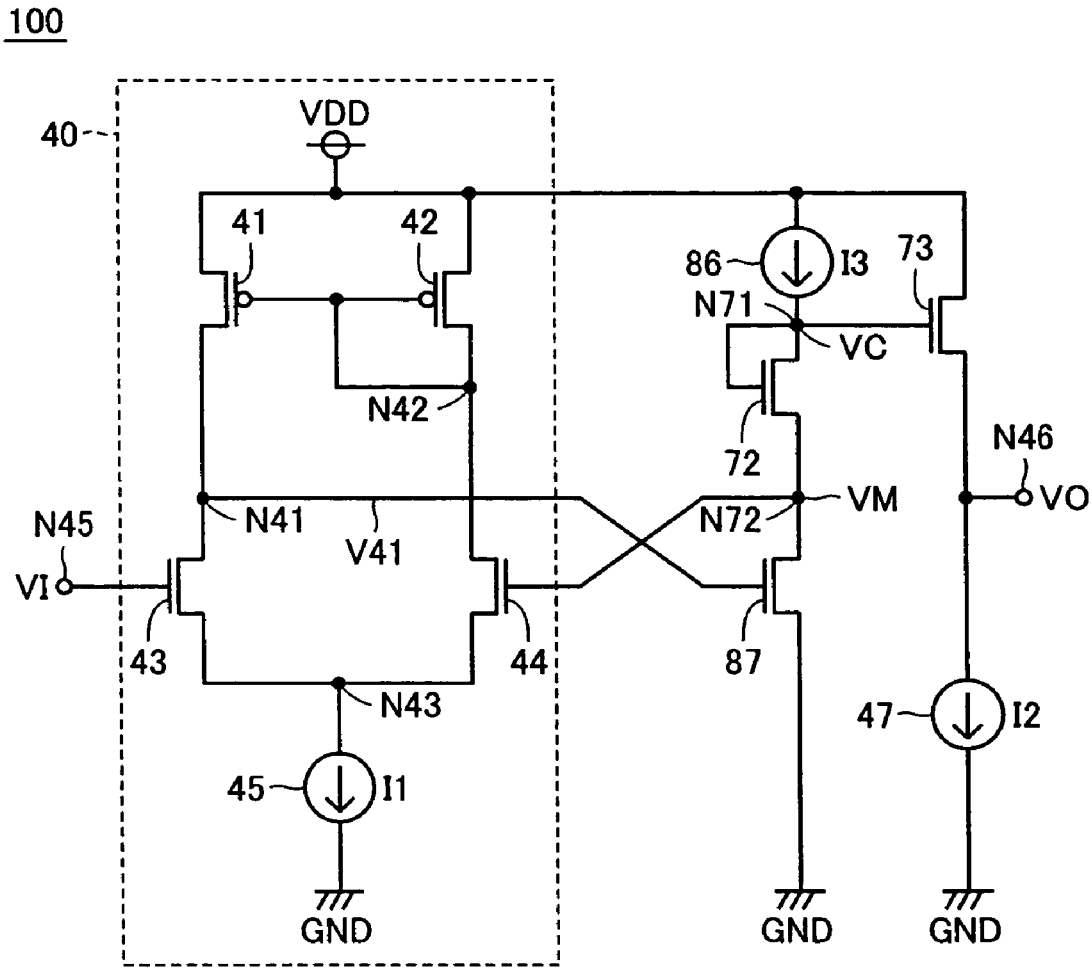
FIG. 18 is a circuit diagram showing another variation of Embodiment 3.

A driving circuit 100 in FIG. 18 is obtained by replacing differential amplifier circuit 50 in driving circuit 85 in FIG. 15 with differential amplifier circuit 40 in FIG. 5. The gate of N-type transistor 87 receives potential V41 of node N41, and the gate of N-type transistor 44 receives monitor potential VM. If monitor potential VM is higher than input potential VI, the current flowing in P-type transistor 41 is larger than the current flowing in N-type transistor 43. That is, potential V41 of node N41 rises and the current flowing in N-type transistor 87 is increased, so as to lower monitor potential VM. If monitor potential VM is lower than input potential VI, the current flowing in P-type transistor 41 is smaller than the current flowing in N-type transistor 43. That is, potential V41 of node N41 is lowered and the current flowing in N-type transistor 87 is decreased, so as to raise monitor potential VM. Therefore, a relation of VM=VI is attained, and also a relation of VO=VI is attained. In this variation as well, an effect the same as in driving circuit 85 in FIG. 15 can be obtained.

Embodiment 4

Figure 19:
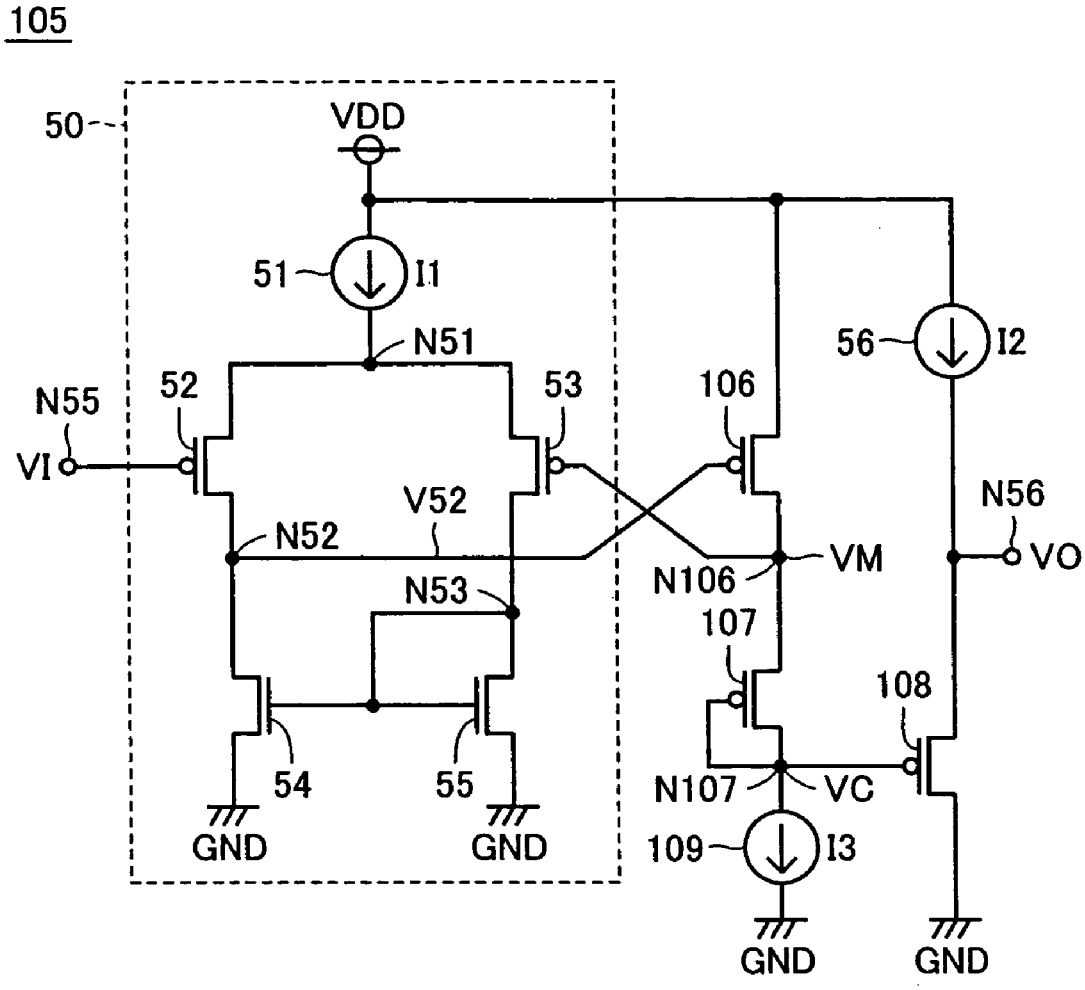
FIG. 19 is a circuit diagram showing a configuration of a pull-type driving circuit in Embodiment 4 of the present invention.

FIG. 19 is a circuit diagram showing a configuration of a pull-type driving circuit 105 in Embodiment 4 of the present invention, and shown in contrast to FIG. 6. In FIG. 19, driving circuit 105 is obtained by replacing N-type transistor 57 in driving circuit 32 in FIG. 6 with P-type transistors 106 to 108 and a constant current circuit 109. As described above, for the sake of simplicity of description and drawings, switch S4 for power supply will not be shown.

P-type transistors 106, 107 and constant current circuit 109 are connected in series between the line of power supply potential VDD and the line of ground potential GND. The gate of P-type transistor 106 receives potential V52 of node N52. The gate of P-type transistor 53 receives potential VM of a node N106 between P-type transistors 106 and 107. The gate of P-type transistor 107 is connected to its drain (node N107). P-type transistor 107 implements a diode element. Constant current circuit 109 causes constant current I3 of a prescribed value to flow out from node N107 to the line of ground potential GND. P-type transistor 108 is connected between output node N56 and the line of ground potential GND, and its gate receives potential VC of node N107.

Monitor potential VM is held at input potential VI by an operation of differential amplifier circuit 50. If monitor potential VM is higher than input potential VI, the current flowing in N-type transistor 54 is smaller than the current flowing in P-type transistor 52 and potential V52 of node N52 rises. In addition, the current flowing in P-type transistor 106 is decreased, so as to lower monitor potential VM. If monitor potential VM is lower than input potential VI, the current flowing in N-type transistor 54 is larger than the current flowing in P-type transistor 52 and potential V52 of node N52 is lowered. In addition, the current flowing in P-type transistor 106 is increased, so as to raise monitor potential VM. Therefore, a relation of VM=VI is attained.

If current drivability of P-type transistor 107 is sufficiently enhanced as compared with constant current I3 of constant current circuit 109, potential VC of node N107 attains VC=VM−|VTP|. Here, VTP is a threshold voltage of the P-type transistor. If current drivability of P-type transistor 108 is sufficiently enhanced as compared with constant current I2 of constant current circuit 56, output potential VO attains VO=VC+|VTP|=VM−|VTM|+|VTP|=VM=VI.

In Embodiment 4, a capacity of a feedback loop to differential amplifier circuit 50 serves as a gate capacity of transistors 53, 107, 108. Therefore, the capacity of the feedback loop to differential amplifier circuit 50 is made sufficiently small, as compared with driving circuit 32 in FIG. 6 in which load capacity is directly connected to differential amplifier circuit 50. Accordingly, an oscillation phenomenon will not take place in driving circuit 105.

Figure 20:
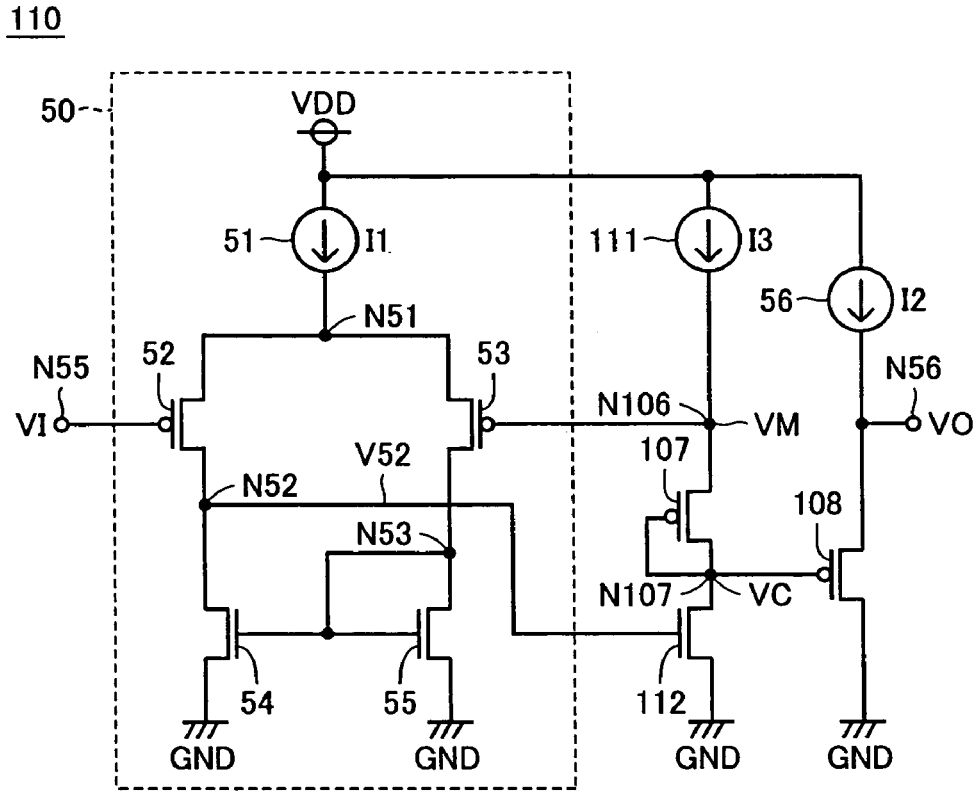
FIG. 20 is a circuit diagram showing a variation of Embodiment 4.

A driving circuit 110 in FIG. 20 is obtained by replacing P-type transistor 106 and constant current circuit 109 in driving circuit 105 in FIG. 19 with a constant current circuit 111 and an N-type transistor 112. Constant current circuit 111 causes constant current I3 of a prescribed value to flow in from the line of power supply potential VDD to node N106. N-type transistor 112 is connected between node N107 and the line of ground potential GND, and its gate receives potential V52 of node N52. If monitor potential VM is higher than input potential VI, potential V52 of node N52 rises and the current flowing in N-type transistor 112 is increased, so as to lower monitor potential VM. If monitor potential VM is lower than input potential VI, potential V52 of node N52 is lowered and the current flowing in N-type transistor 112 is decreased, so as to raise monitor potential VM. Therefore, a relation of VM=VI is attained, and also a relation of VO=VI is attained. In this variation as well, an effect the same as in driving circuit 105 in FIG. 19 can be obtained.

Figure 21:
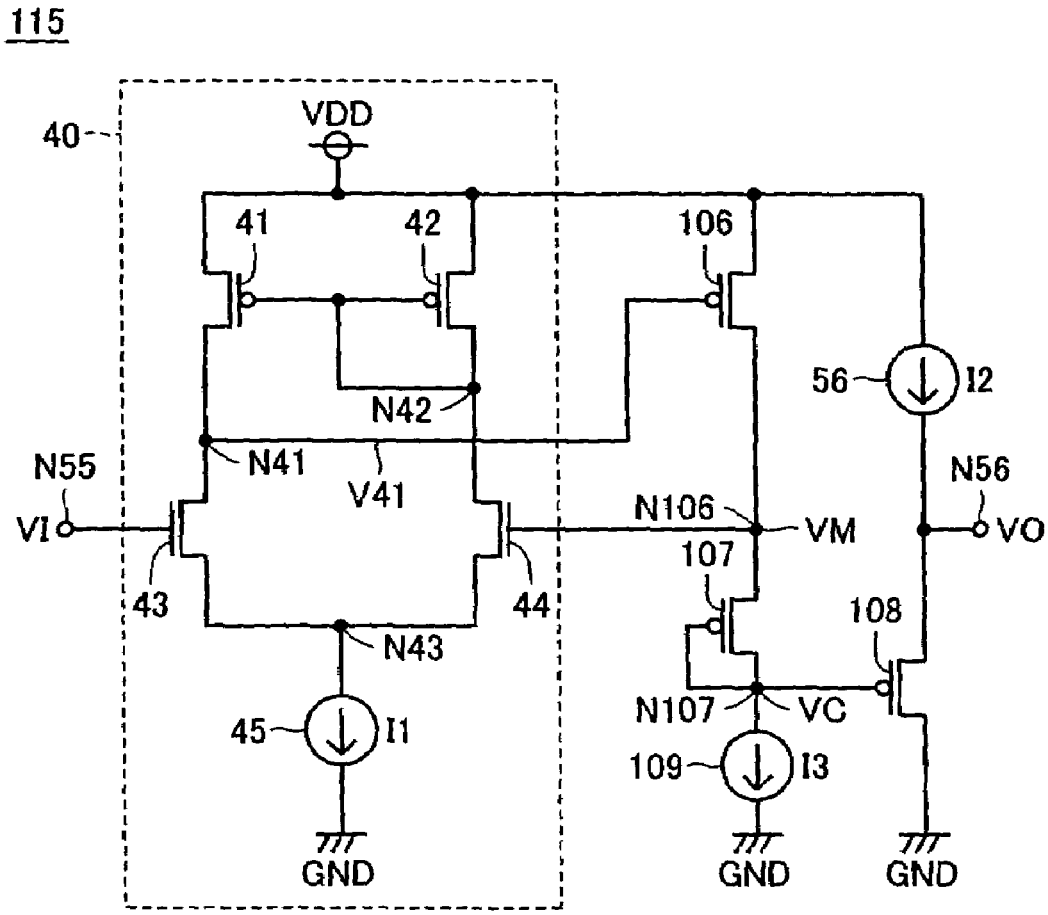
FIG. 21 is a circuit diagram showing another variation of Embodiment 4.

A driving circuit 115 in FIG. 21 is obtained by replacing differential amplifier circuit 50 in driving circuit 105 in FIG. 19 with differential amplifier circuit 40 in FIG. 5. If monitor potential VM is higher than input potential VI, potential V41 of node N41 rises and the current flowing in P-type transistor 106 is decreased, so as to lower monitor potential VM. If monitor potential VM is lower than input potential VI, potential V41 of node N41 is lowered and the current flowing in P-type transistor 106 is increased, so as to raise monitor potential VM. Therefore, a relation of VM=VI is attained, and also a relation of VO=VI is attained. In this variation as well, an effect the same as in driving circuit 105 in FIG. 19 can be obtained.

Embodiment 5

Figure 22:
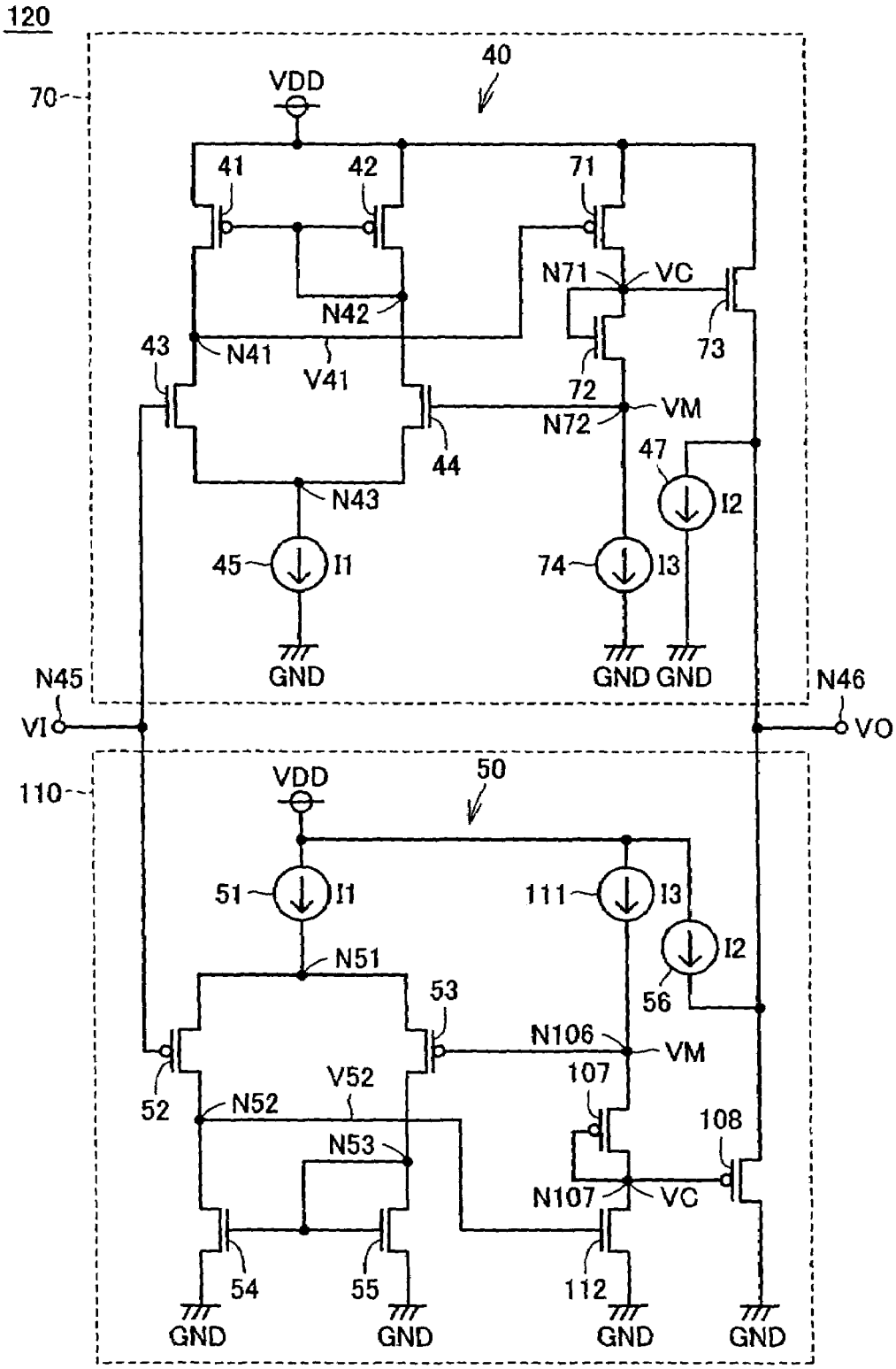
FIG. 22 is a circuit diagram showing a configuration of a push-pull-type driving circuit in Embodiment 5 of the present invention.

FIG. 22 is a circuit diagram showing a configuration of a push-pull-type driving circuit 120 in Embodiment 5 of the present invention. In FIG. 22, driving circuit 120 is obtained by combining push-type driving circuit 70 in FIG. 11 and pull-type driving circuit 110 in FIG. 20. Input node N45 of push-type driving circuit 70 is connected to an input node of pull-type driving circuit 110, and output node N46 of push-type driving circuit 70 is connected to an output node of pull-type driving circuit 110.

If output potential VO is higher than input potential VI, the gate-source voltage of N-type transistor 73 is set lower than threshold voltage VTN of N-type transistor 73, to render N-type transistor 73 non-conductive. In addition, the source-gate voltage of P-type transistor 108 is set higher than the absolute value of threshold voltage VTP of P-type transistor 108, to render P-type transistor 108 conductive, resulting in lowering of output potential VO.

If output potential VO is lower than input potential VI, the source-gate voltage of P-type transistor 108 is lower than the absolute value of threshold voltage VTP of P-type transistor 108, to render P-type transistor 108 non-conductive. In addition, the gate-source voltage of N-type transistor 73 is set higher than threshold voltage VTN of N-type transistor 73, to render N-type transistor 73 conductive, resulting in rise of output potential VO. Therefore, a relation of VO=VI is attained.

A driving circuit 120 is used as push-type driving circuit 31 or pull-type driving circuit 32 in FIG. 4 or FIG. 5. When driving circuit 120 is used as push-type driving circuit 31, current drivability of P-type transistor 108 for discharging is set to a sufficiently low level, as compared with that of N-type transistor 73 for charging. When driving circuit 120 is used as pull-type driving circuit 32, current drivability of N-type transistor 73 for charging is set to a sufficiently low level, as compared with that of P-type transistor 108 for discharging. Therefore, the through current in driving circuits 31, 32 can be reduced, and power consumption can be lowered.

Embodiment 5 achieves not only an effect the same as in Embodiment 2, but also lower power consumption.

Figure 23:
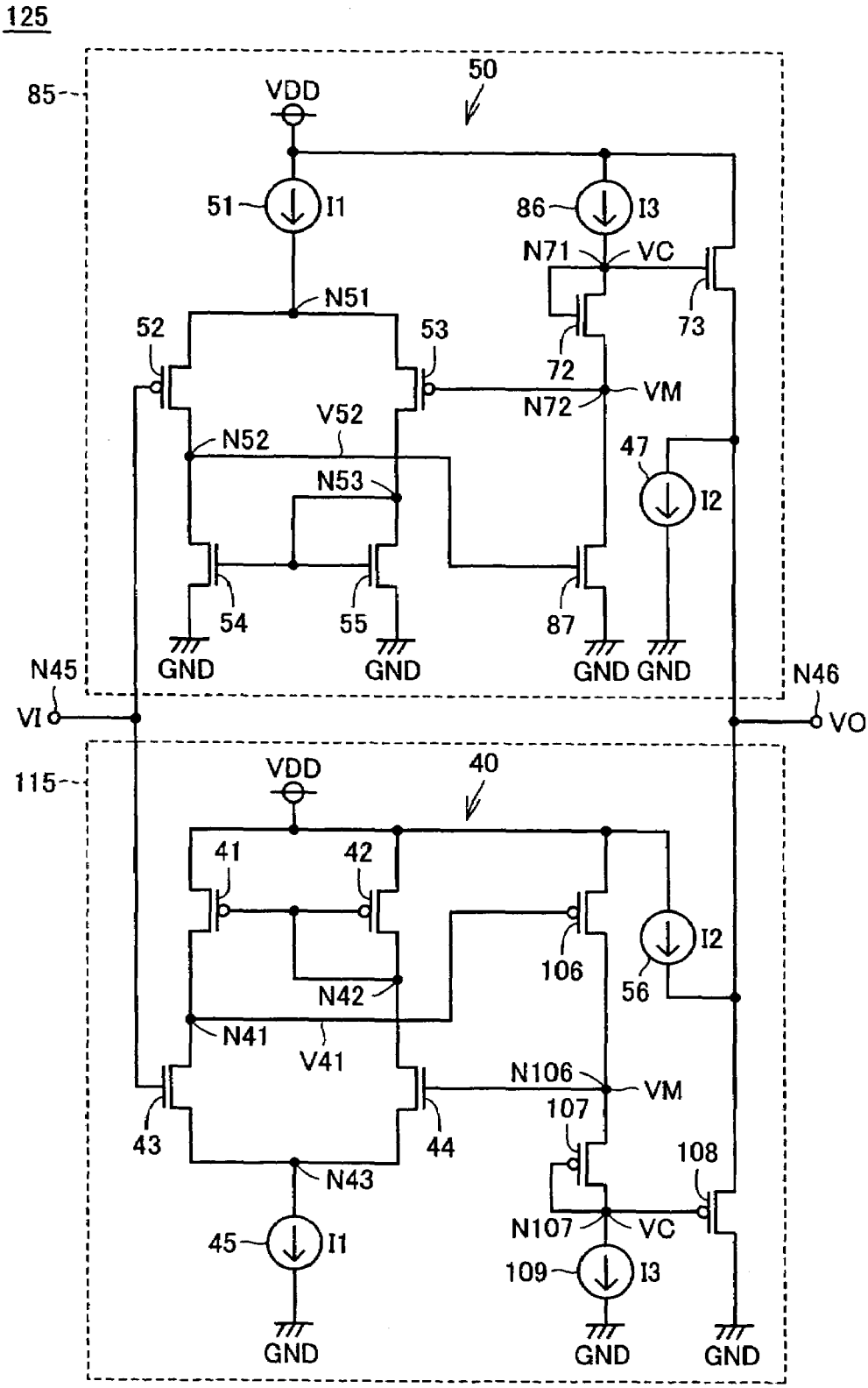
FIG. 23 is a circuit diagram showing a variation of Embodiment 5.

In the following, several variations will be described. A push-pull-type driving circuit 125 in FIG. 23 is obtained by combining push-type driving circuit 85 in FIG. 15 with pull-type driving circuit 115 in FIG. 21. Input node N45 of push-type driving circuit 85 is connected to an input node of pull-type driving circuit 115, and output node N46 of push-type driving circuit 85 is connected to an output node of pull-type driving circuit 115. In this variation as well, an effect the same as in driving circuit 120 in FIG. 22 can be obtained.

Figure 24:
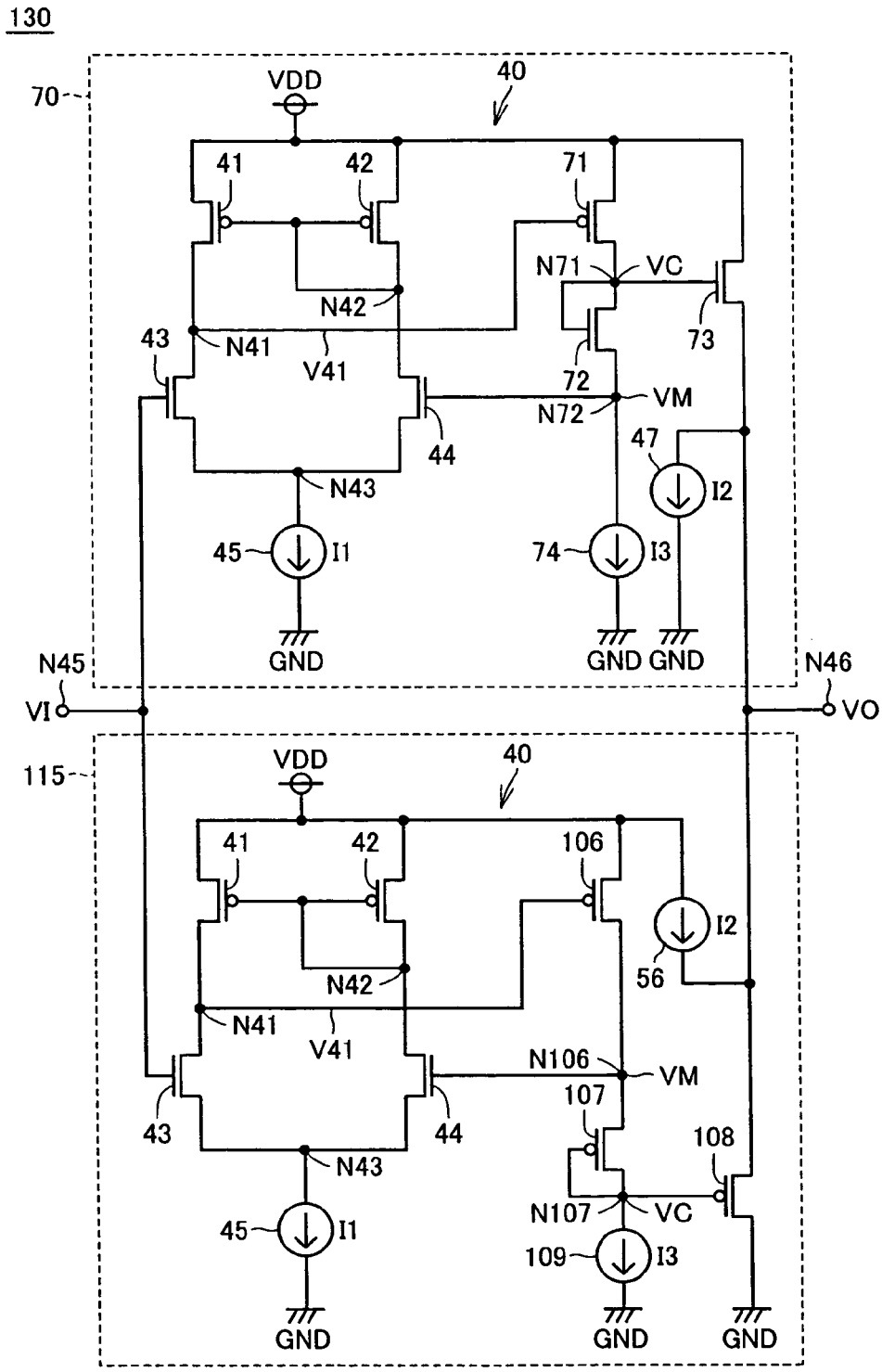
FIG. 24 is a circuit diagram showing another variation of Embodiment 5.
Figure 25:
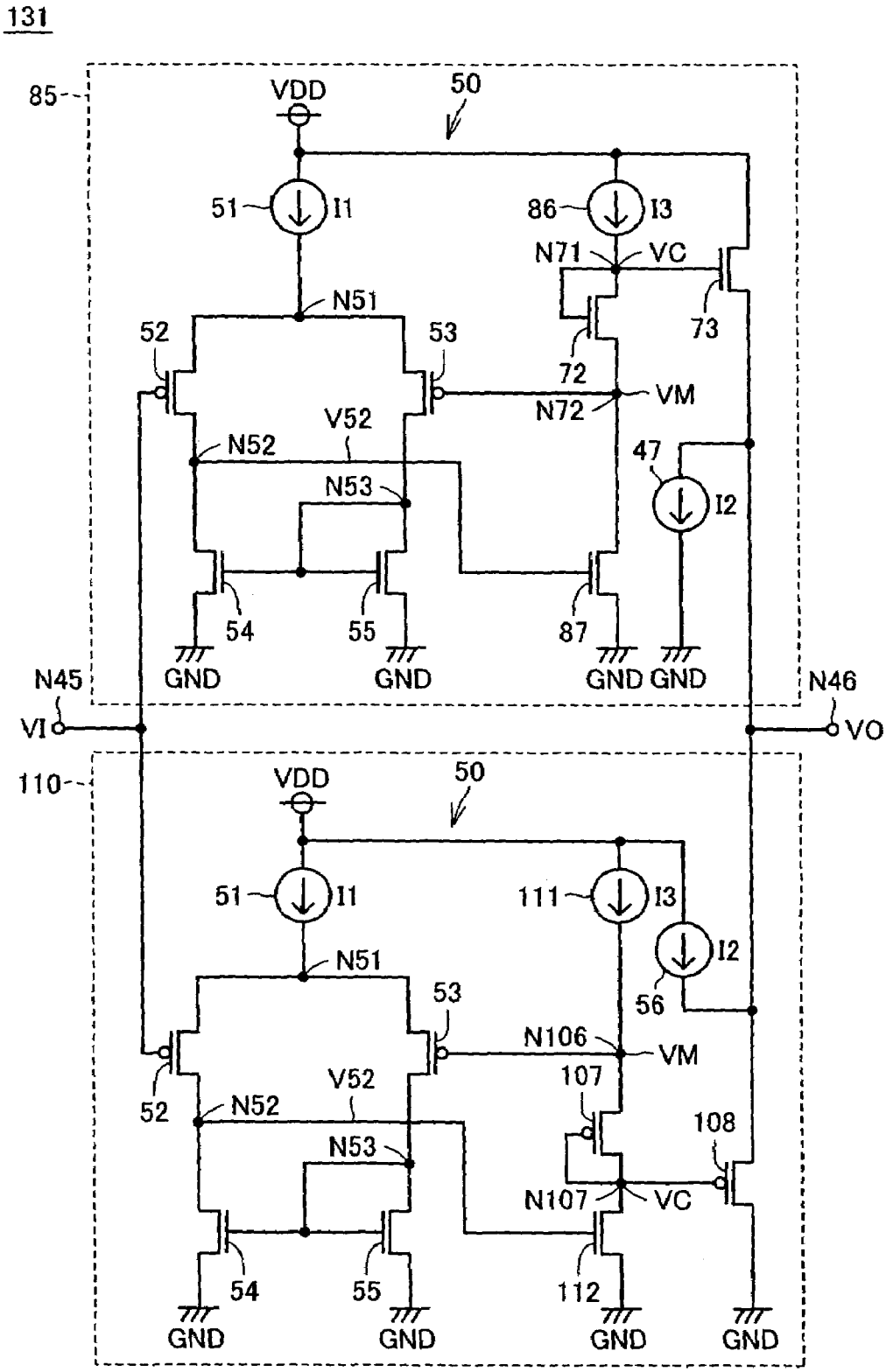
FIG. 25 is a circuit diagram showing yet another variation of Embodiment 5.

A push-pull-type driving circuit 130 in FIG. 24 is obtained by combining push-type driving circuit 70 in FIG. 11 with pull-type driving circuit 115 in FIG. 21. A push-pull-type driving circuit 131 in FIG. 25 is obtained by combining push-type driving circuit 85 in FIG. 15 with pull-type driving circuit 110 in FIG. 20. In these variations as well, an effect the same as in driving circuit 120 in FIG. 22 can be obtained. Here, in push-pull-type driving circuits 120, 125, 130, 131, one or both of constant current circuits 47, 56 may not be provided.

Embodiment 6

Figure 26:
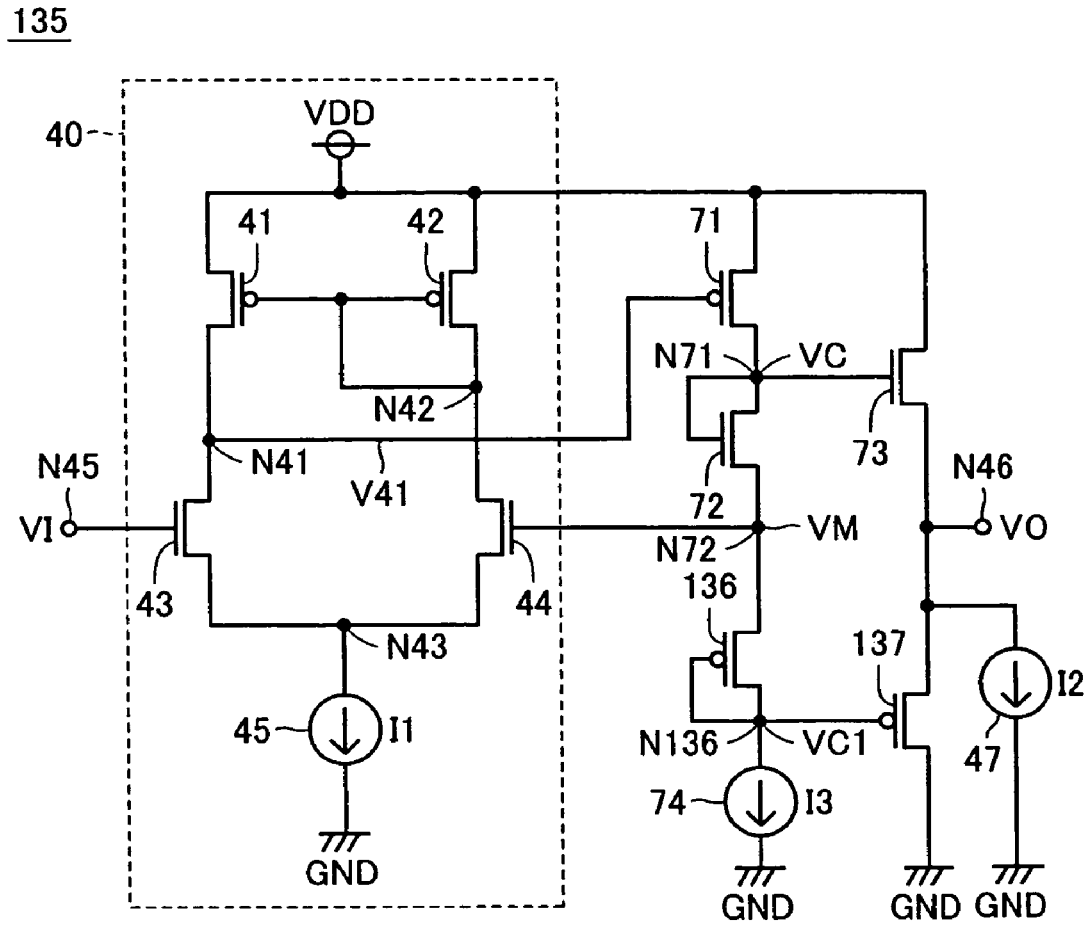
FIG. 26 is a circuit diagram showing a configuration of a push-pull-type driving circuit in Embodiment 6 of the present invention.

FIG. 26 is a circuit diagram showing a configuration of a push-pull-type driving circuit 135 in Embodiment 6 of the present invention. Referring to FIG. 26, driving circuit 135 is obtained by adding P-type transistors 136, 137 to push-type driving circuit 70 in FIG. 11. P-type transistor 136 and constant current circuit 74 are connected in series between node N72 and the line of ground potential GND, and the gate of P-type transistor 136 is connected to its drain (node N136). P-type transistor 136 implements a diode element. P-type transistor 137 is connected between output node N46 and the line of ground potential GND, and its gate receives potential a VC1 of node N136.

Potential VM of node N72 is set to VM=VI by an operation of differential amplifier circuit 40. Therefore, potential VC of node N71 attains VC=VI+VTN, and potential VC1 of node N136 attains VC1=VI−|VTP|. If output potential VO is higher than input potential VI, N-type transistor 73 is rendered non-conductive and P-type transistor 137 is rendered conductive. If output potential VO is lower than input potential VI, P-type transistor 137 is rendered non-conductive and N-type transistor 73 is rendered conductive. Therefore, a relation of VO=VI is attained.

Embodiment 6 achieves not only an effect the same as in Embodiment 5 but also smaller layout area, because a single differential amplifier circuit is provided.

Here, constant current circuit 47 may not be provided.

Embodiment 7

Figure 27:
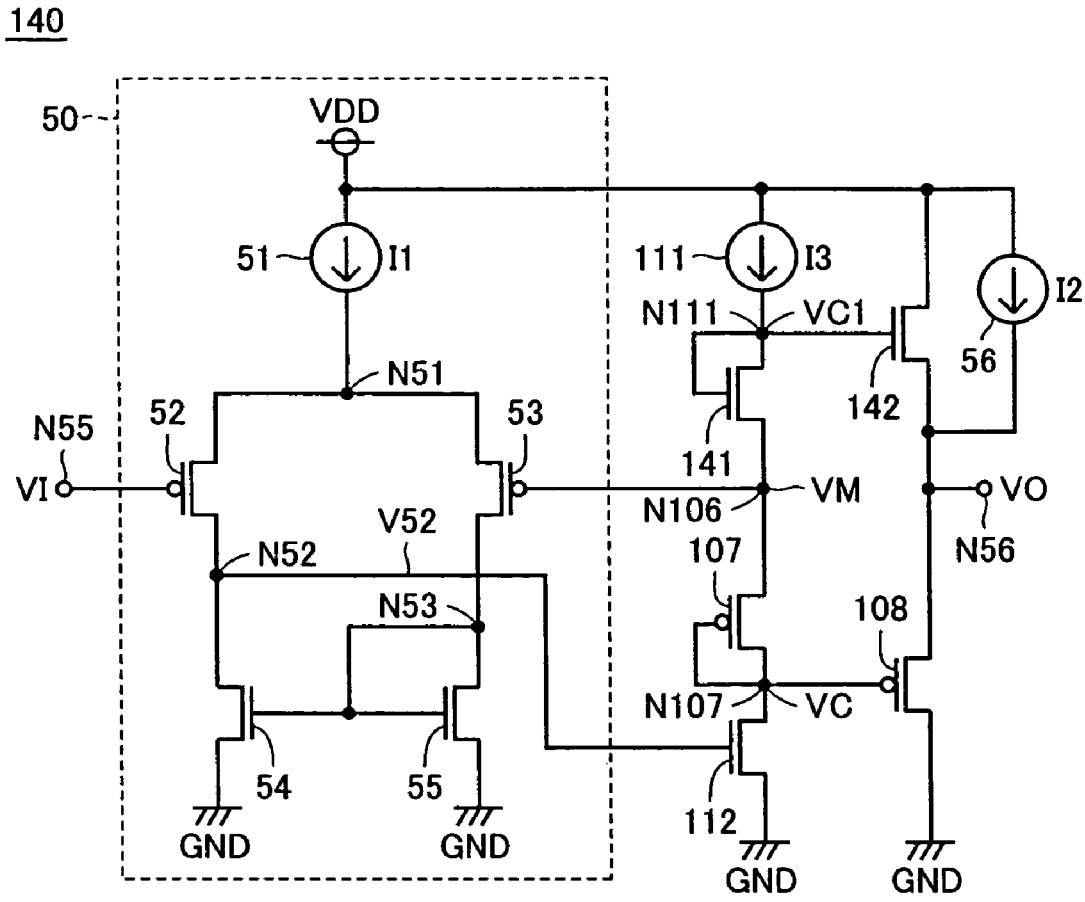
FIG. 27 is a circuit diagram showing a configuration of a push-pull-type driving circuit in Embodiment 7 of the present invention.

FIG. 27 is a circuit diagram showing a configuration of a push-pull-type driving circuit 140 in Embodiment 7 of the present invention. Referring to FIG. 27, driving circuit 140 is obtained by adding N-type transistors 141, 142 to pull-type driving circuit 110 in FIG. 20. Constant current circuit 111 and N-type transistor 141 are connected in series between the line of power supply potential VDD and node N106, and the gate of N-type transistor 141 is connected to its drain (node N 111). N-type transistor 141 implements a diode element. N-type transistor 142 is connected between the line of power supply potential VDD and output node N56, and its gate receives potential VC1 of node N111.

Potential VM of node N106 is set to VM=VI by an operation of differential amplifier circuit 50. Therefore, potential VC1 of node N111 attains VC1=VI+VTN, and potential VC of node N107 attains VC=VI−|VTP|. If output potential VO is higher than input potential VI, N-type transistor 142 is rendered non-conductive and P-type transistor 108 is rendered conductive. If output potential VO is lower than input potential VI, P-type transistor 108 is rendered non-conductive and N-type transistor 142 is rendered conductive. Therefore, a relation of VO=VI is attained.

Embodiment 7 also achieves an effect the same as in Embodiment 6.

Here, constant current circuit 56 may not be provided.

Embodiment 8

Figure 28:
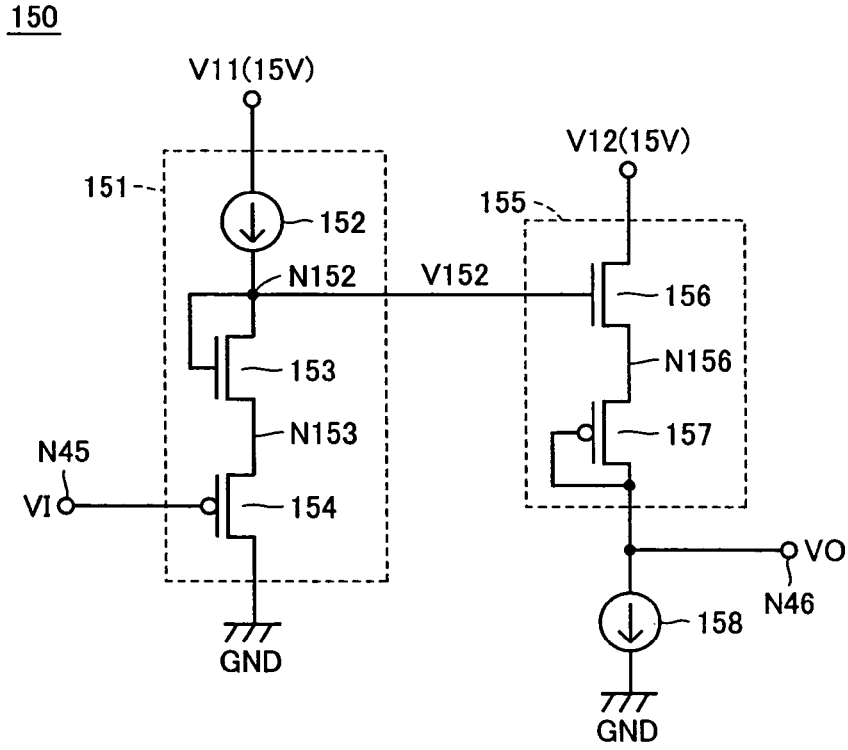
FIG. 28 is a circuit diagram showing a configuration of a push-type driving circuit in Embodiment 8 of the present invention.

FIG. 28 is a circuit diagram showing a configuration of a push-type driving circuit 150 in Embodiment 8 of the present invention. In FIG. 28, driving circuit 150 includes a level shift circuit 151, a pull-up circuit 155 and a constant current circuit 158.

Level shift circuit 151 includes a constant current circuit 152, an N-type transistor 153 and a P-type transistor 154 connected in series between a node of a power supply potential V11 (15V) and a node of ground potential GND. The gate of N-type transistor 153 is connected to its drain (node N152). N-type transistor 153 implements a diode element. The gate of P-type transistor 154 receives potential VI of input node N45. Current drivability of constant current circuit 152 is set to a level sufficiently lower than that of transistors 153, 154.

A potential V153 of the source (node N153) of P-type transistor 154 is set to V153=VI+|VTP|, and a potential V152 of the drain (node N152) of N-type transistor 153 is set to V152=VI+|VTP|+VTN. Therefore, level shift circuit 151 outputs potential VI 52 obtained by level-shifting input potential VI by |VTP|+VTN.

Pull-up circuit 155 includes an N-type transistor 156 and a P-type transistor 157 connected in series between a node of power supply potential V12 (15V) and output node N46. Constant current circuit 158 is connected between output node N46 and the line of ground potential GND. The gate of N-type transistor 156 receives output potential V152 of level shift circuit 151. The gate of P-type transistor 157 is connected to its drain. P-type transistor 157 implements a diode element. In N-type transistor 156, as power supply potential V12 is set in order for N-type transistor 156 to operate in the saturation region, N-type transistor 156 performs what is called a source follower operation. Current drivability of constant current circuit 158 is set to a level sufficiently lower than that of transistors 156, 157.

A potential V156 of the source (node N156) of N-type transistor 156 is set to V156=V152−VTN=VI+|VTP|, and potential VO of output node N46 is set to VO=V156−|VTP|=VI.

As output potential VO is not fed back at all in Embodiment 8, an oscillation phenomenon will not take place in driving circuit 150.

Embodiment 9

Figure 29:
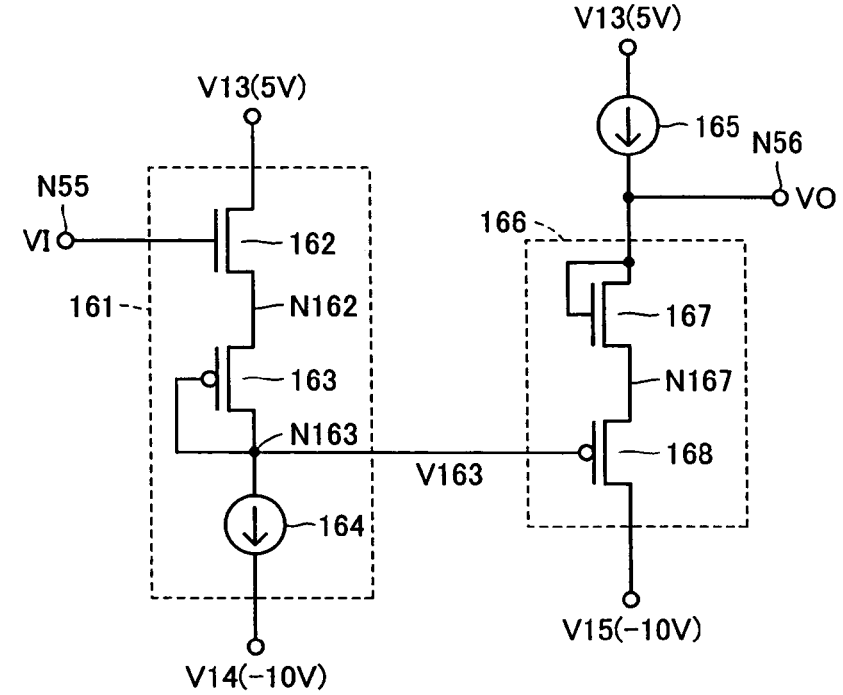
FIG. 29 is a circuit diagram showing a configuration of a pull-type driving circuit in Embodiment 9 of the present invention.

FIG. 29 is a circuit diagram showing a configuration of a pull-type driving circuit 160 in Embodiment 9 of the present invention. In FIG. 29, driving circuit 160 includes a level shift circuit 161, a constant current circuit 165 and a pull-down circuit 166.

Level shift circuit 161 includes an N-type transistor 162, a P-type transistor 163, and a constant current circuit 164 connected in series between a node of a power supply potential V13 (5V) and a node of a power supply potential V14 (−10V). The gate of N-type transistor 162 receives a potential of input node N55. The gate of P-type transistor 163 is connected to its drain (node N163). P-type transistor 163 implements a diode element. Current drivability of constant current circuit 164 is set to a level sufficiently lower than that of transistors 162, 163.

A potential V162 of the source (node N162) of N-type transistor 162 is set to V162=VI−VTN, and a potential V163 of the drain (node N163) of P-type transistor 163 is set to V163=VI−VTN−|VTP|. Therefore, level shift circuit 161 outputs potential V163 obtained by level-shifting input potential VI by −VTN−|VTP|.

Constant current circuit 165 is connected between the node of power supply potential V13 and output node N56. Pull-down circuit 166 includes a P-type transistor 168 and an N-type transistor 167 connected in series between a node of a power supply potential V15 (−10V) and an output node N166. The gate of P-type transistor 168 receives output potential V163 of level shift circuit 161. The gate of N-type transistor 167 is connected to its drain. N-type transistor 167 implements a diode element. In P-type transistor 168, as power supply potential V15 is set in order for P-type transistor 168 to operate in the saturation region, P-type transistor 168 performs what is called a source follower operation. Current drivability of constant current circuit 165 is set to a level sufficiently lower than that of transistors 167, 168.

A potential V167 of the source (node N167) of P-type transistor 168 is set to V167=V163+|VTP|=VI−VTN, and potential VO of output node N56 is set to VO=V167+VTN=VI.

Embodiment 9 also attains an effect the same as in Embodiment 8.

Embodiment 10

Figure 30:
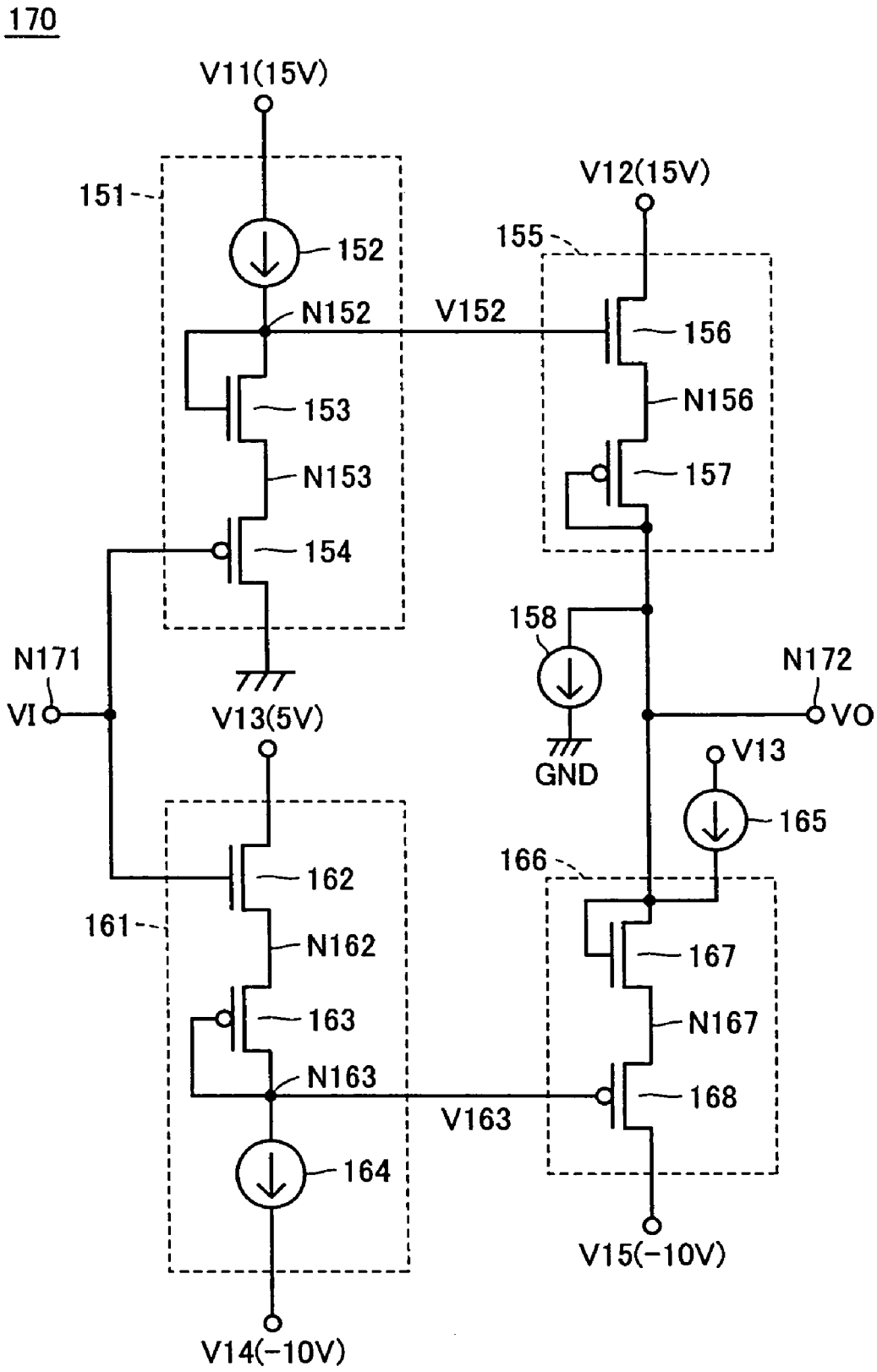
FIG. 30 is a circuit diagram showing a configuration of a push-pull-type driving circuit in Embodiment 10 of the present invention.

FIG. 30 is a circuit diagram showing a configuration of a push-pull-type driving circuit 170 in Embodiment 10 of the present invention. In FIG. 30, driving circuit 170 is obtained by combining push-type driving circuit 150 in FIG. 28 with pull-type driving circuit 160 in FIG. 29. The gate of P-type transistor 154 in level shift circuit 151 and the gate of N-type transistor 162 in level shift circuit 161 receive potential VI of an input node N171. The drain of P-type transistor 157 in pull-up circuit 155 and the drain of N-type transistor 167 in pull-down circuit 166 are both connected to an output node N172.

When output potential VO is higher than input potential VI, transistors 156, 157 in pull-up circuit 155 are rendered non-conductive and transistors 167, 168 in pull-down circuit 166 are rendered conductive, to lower output potential VO. When output potential VO is lower than input potential VI, transistors 167, 168 in pull-down circuit 166 are rendered non-conductive and transistors 156, 157 in pull-up circuit 155 are rendered conductive, to raise output potential VO. Therefore, a relation of VO=VI is attained.

Driving circuit 170 is used as push-type driving circuit 31 or pull-type driving circuit 32 in FIG. 4 or FIG. 5. When driving circuit 170 is used as push-type driving circuit 31, current drivability of transistors 167, 168 in pull-down circuit 166 is set to a sufficiently low level, as compared with that of transistors 156, 157 in pull-up circuit 155. When driving circuit 170 is used as pull-type driving circuit 32, current drivability of transistors 156, 157 in pull-up circuit 155 is set to a sufficiently low level, as compared with that of transistors 167, 168 in pull-down circuit 166. Therefore, the through current in driving circuits 31, 32 can be reduced, and power consumption can be lowered.

Embodiment 10 achieves not only an effect the same as in Embodiment 8 but also lower power consumption.

Figure 31:
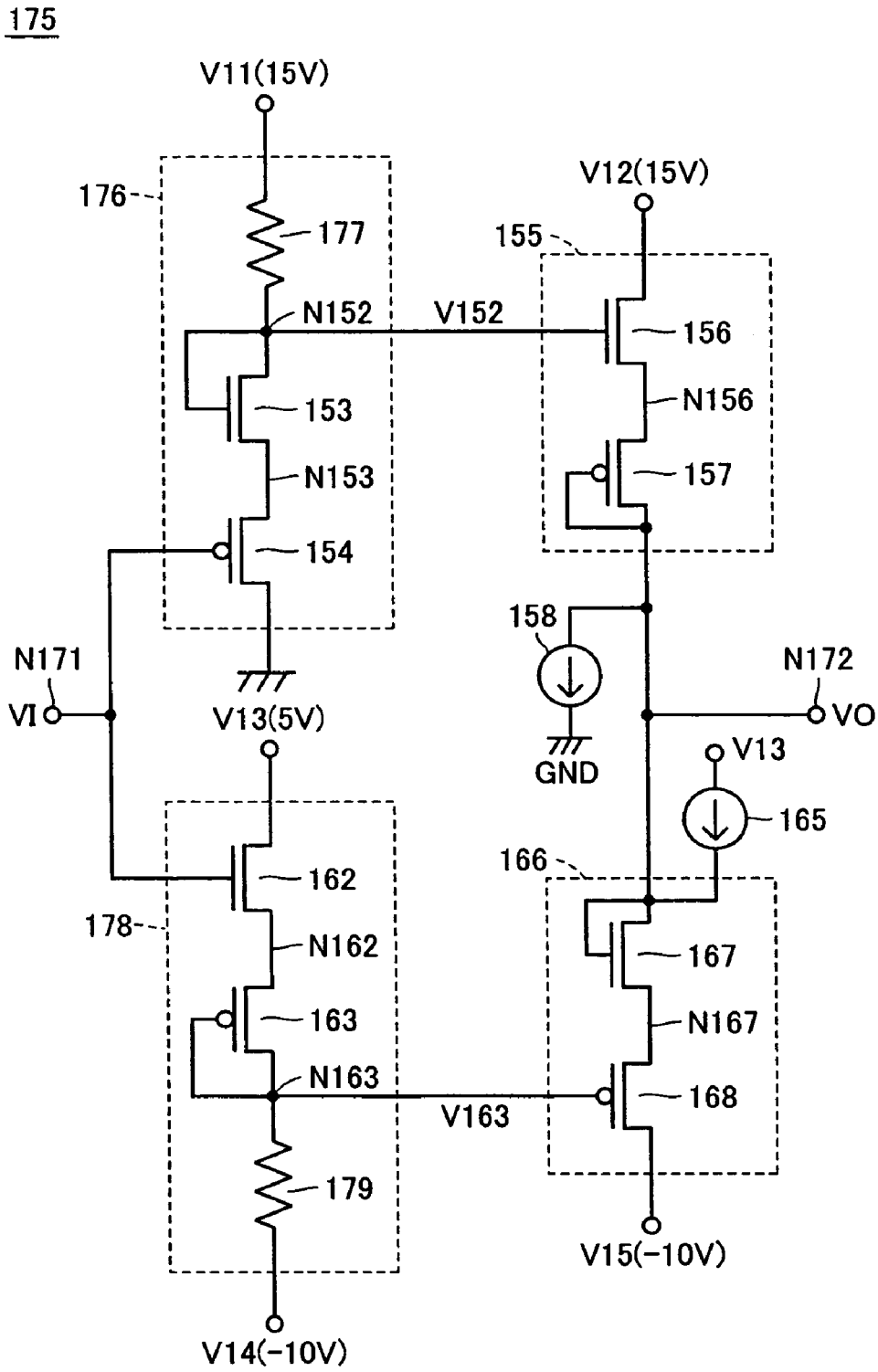
FIG. 31 is a circuit diagram showing a variation of Embodiment 10.

FIG. 31 is a circuit diagram showing a configuration of a push-pull-type driving circuit 175 in a variation of Embodiment 10. In FIG. 31, push-pull-type driving circuit 175 is obtained by replacing level shift circuits 151, 152 in push-pull-type driving circuit 170 in FIG. 30 with level shift circuits 176, 178 respectively. Level shift circuit 176 is obtained by replacing constant current circuit 152 in level shift circuit 151 with a resistance element 177. Level shift circuit 178 is obtained by replacing constant current circuit 164 in level shift circuit 161 with a resistance element 179. Resistance values of resistance elements 177, 179 are set to such a value that resistance elements 177, 179 allow a current flow in an amount approximately the same as constant current circuits 152, 164. In this variation as well, an effect the same as in push-pull-type driving circuit 170 in FIG. 30 can be obtained.

Here, in push-pull-type driving circuits 170, 175, one or both of constant current circuits 158, 165 may not be provided.

Embodiment 11

Figure 32:
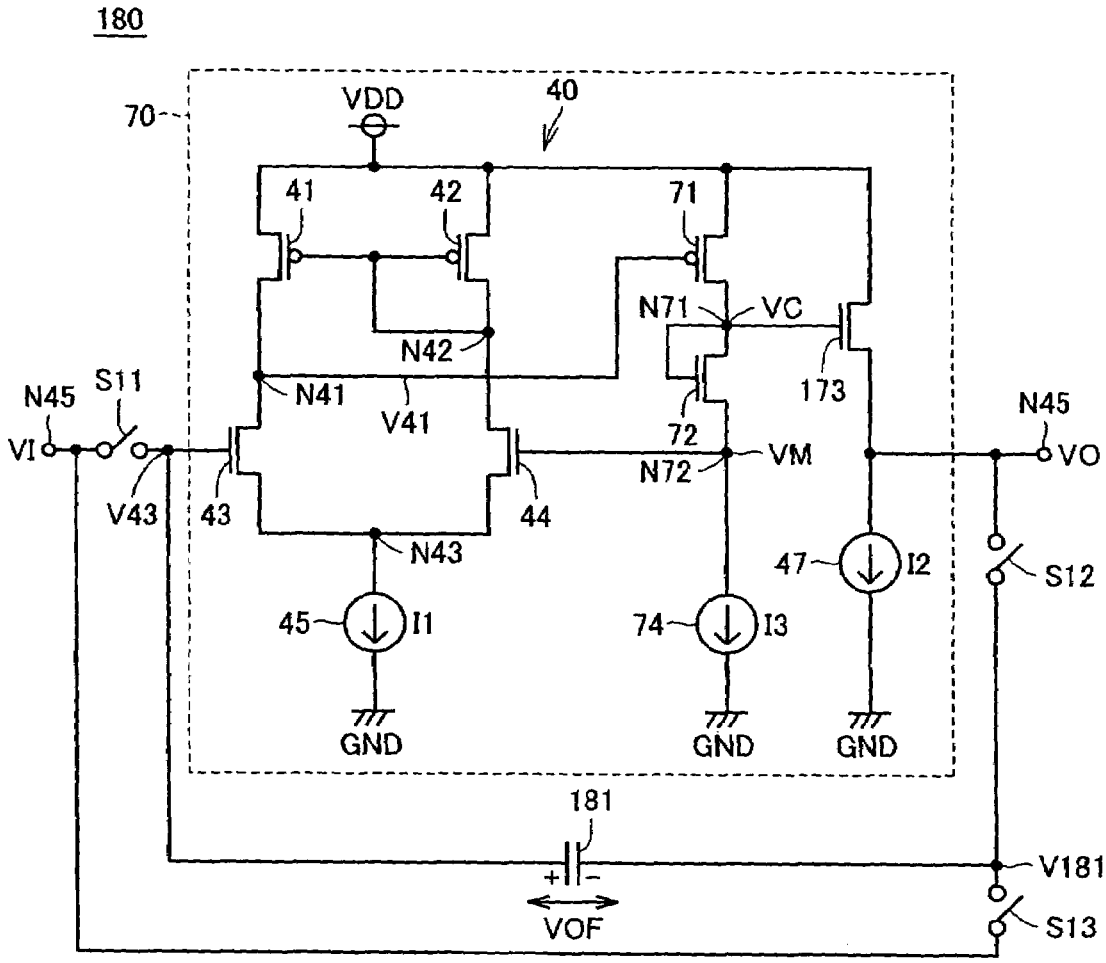
FIG. 32 is a circuit diagram showing a configuration of a push-type driving circuit with an offset compensation function in Embodiment 11 of the present invention.

FIG. 32 is a circuit diagram showing a configuration of a push-type driving circuit 180 with an offset compensation function in Embodiment 11 of the present invention. In FIG. 32, push-type driving circuit 180 with the offset compensation function includes driving circuit 70, a capacitor 181, and switches S11 to S13. Driving circuit 70 is the same as that shown in FIG. 11. Capacitor 181 and switches S11 to S13 constitute an offset compensation circuit for compensating an offset voltage VOF, if a potential difference, that is, offset voltage VOF, between input potential VI and output potential VO of driving circuit 70 due to variation of threshold voltages among transistors in driving circuit 70.

Switch S1 is connected between input node N45 and the gate of N-type transistor 43. Capacitor 181 and switch S12 are connected in series between the gate of N-type transistor 43 and output node N45, and switch S13 is connected between input node N45 and a node between capacitor 181 and switch S12. Each of switches S11 to S13 may be a P-type transistor, an N-type transistor, or a combination of P-type transistor and N-type transistor connected in parallel. Each of switches S11 to S13 is on/off-controlled by a control signal (not shown).

Figure 33:
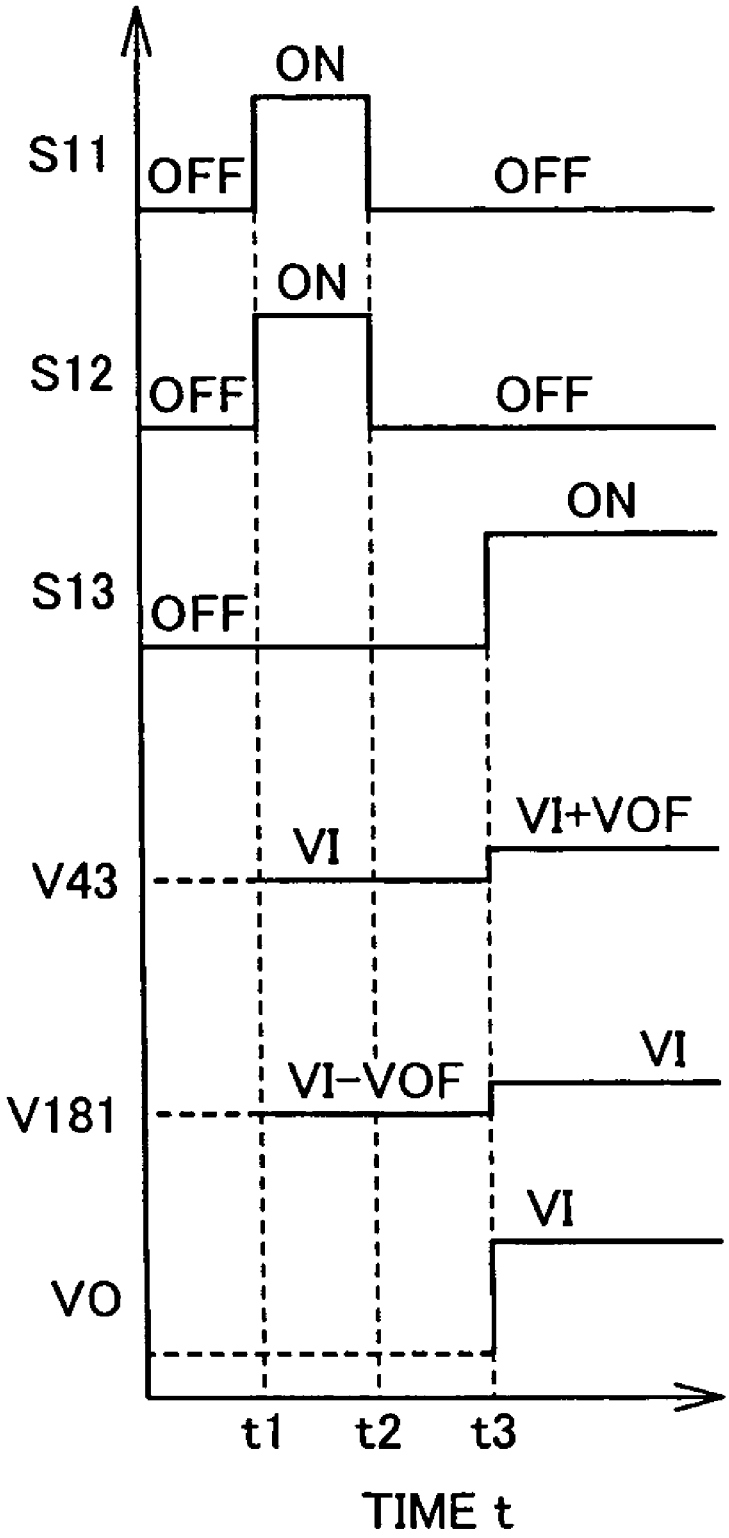
FIG. 33 is a time chart showing an operation of the push-type driving circuit with the offset compensation function shown in FIG. 32.

Here, an example in which output potential VO of driving circuit 1 is lower than input potential VI by offset voltage VOF will be described. Referring to FIG. 33, at an initial state, all switches S11 to S13 are turned off. When switches S11, S12 are turned on at time t1, output potential VO is set to VO=VI−VOF, and capacitor 181 is charged to offset voltage VOF.

Then, when switches S11, S12 are turned off at time t2, offset voltage VOF is held in capacitor 181. When switch S13 is turned on at time t3, gate potential V43 of N-type transistor 43 is set to VI+VOF. As a result, output potential VO of driving circuit 70 is set to VO=VI+VOF−VOF=VI, which means that offset voltage VOF of driving circuit 70 is canceled.

In Embodiment 11, offset voltage VOF of driving circuit 70 can be canceled, and output potential VO can be set equal to input potential VI with high accuracy.

Though an example in which offset voltage VOF of driving circuit 70 is canceled has been described in Embodiment 11, offset voltage VOF of driving circuits 31, 32, 80, 81, 85, 95, 100, 105, 110, 115, 135, 140, 150, 160 can be canceled with the same method.

Figure 34:
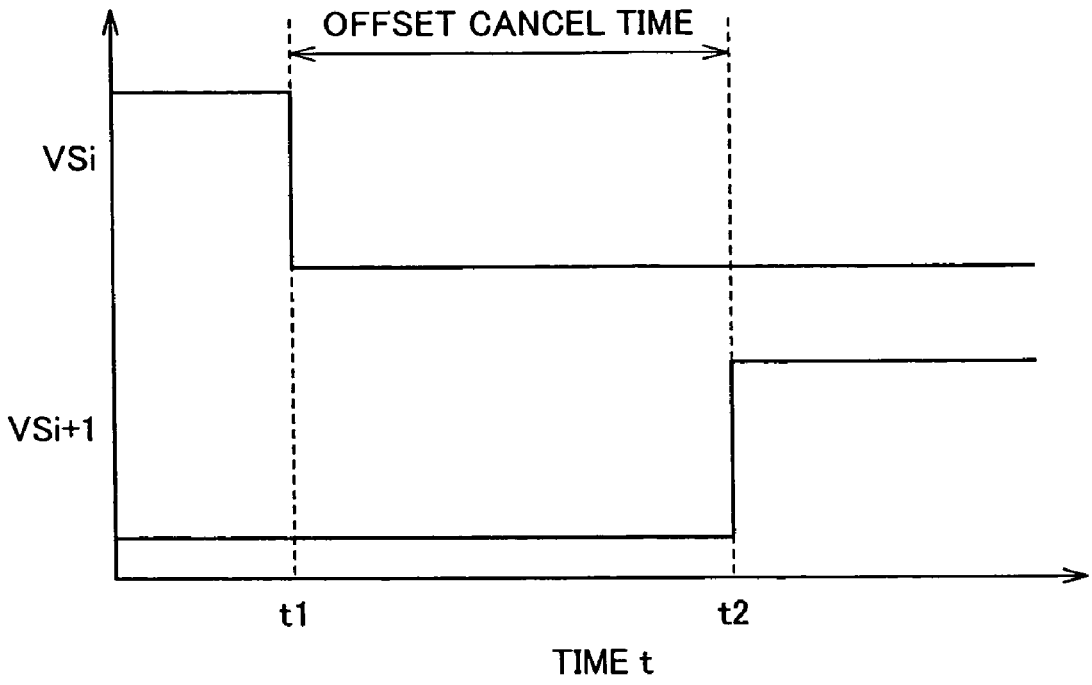
FIG. 34 is another time chart showing the operation of the push-type driving circuit with the offset compensation function shown in FIG. 32.

In addition, as shown in FIG. 34, an operation to compensate offset voltage VOF is preferably performed during a blanking period, which is from a time point of fall of a potential VSi of ith (i is an integer not smaller than 1) scanning line 4 from "H" level to "L" level to a time point of rise of a potential VSi+1 of i+1th scanning line 4 from "L" level to "H" level. Alternatively, an operation to compensate offset voltage VOF is preferably performed during a blanking period between 2 frames. If the operation to compensate offset voltage VOF is performed during the blanking period, lowering of an image display frequency due to this operation will be avoided.

Embodiment 12

Figure 35:
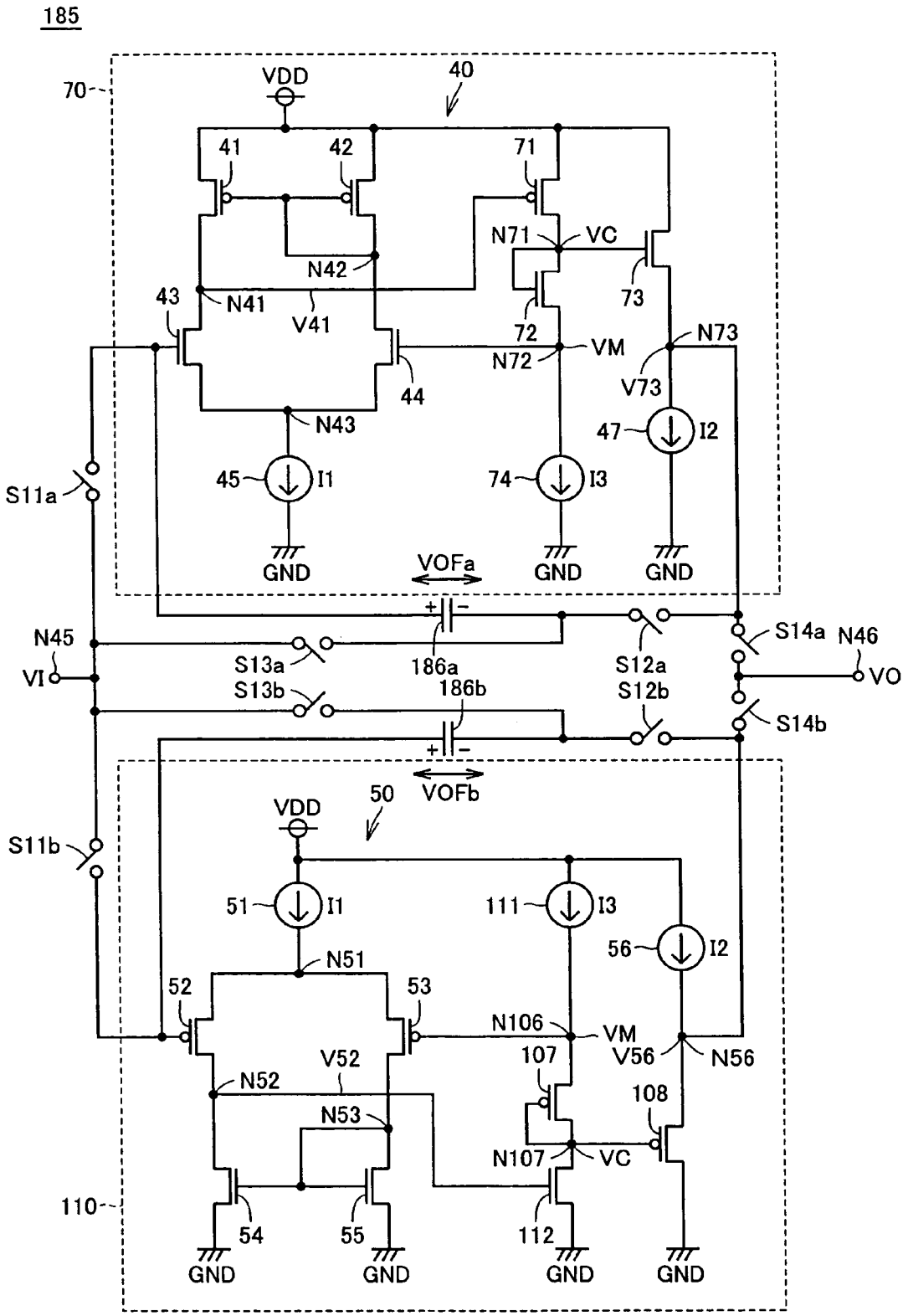
FIG. 35 is a circuit diagram showing a configuration of a push-pull-type driving circuit with an offset compensation function in Embodiment 12 of the present invention.

FIG. 35 is a circuit diagram showing a configuration of a push-pull-type driving circuit 185 with an offset compensation function in Embodiment 12 of the present invention. In FIG. 35, driving circuit 185 includes driving circuit 120 in FIG. 22, capacitors 186*a*, 186*b*, and switches S11*a* to S14*a*, S11*b* to S14*b*.

Switches S11*a*, S11*b* are connected between input node N45 and the gates of N-type transistors 43, 52 in driving circuits 70, 115 respectively. Capacitor 186*a* and switch S12*a* are connected in series between the gate of N-type transistor 43 in driving circuit 70 and the source (node N73) of N-type transistor 73. Capacitor 186*b* and switch S12*b* are connected in series between the gate of P-type transistor 52 in driving circuit 110 and the source (node N56) of P-type transistor 108. Switch S13*a* is connected between input node N45 and a node between capacitor 186*a* and switch S12*a*. Switch S13*b* is connected between input node N45 and a node between capacitor 186*b* and switch S12*b*. Switches S14*a*, S14*b* are connected between nodes N73, N56 and output node N46 respectively.

An operation of driving circuit 185 will now be described. At an initial state, all switches S11*a* to S14*a*, S11*b* to S14*b* are turned off. When switches S11*a*, S12*a*, S11*b*, S12*b* are turned on at a certain time, potentials V73, V56 of nodes N73, N56 are set to V73=VI−VOFa and V56=VI−VOFb respectively, and capacitors 186*a*, 186*b* are charged to offset voltages VOFa, VOFb respectively.

When switches S11*a*, S12*a*, S11*b*, S12*b* are turned off, offset voltages VOFa, VOFb are held in capacitors 186*a*, 186*b* respectively. When switches S13*a*, S13*b* are turned on, the gate potentials of N-type transistors 43, 52 of driving circuits 70, 110 are both set to VI+VOFa and VI+VOFb. As a result, output potentials V73, V56 of driving circuits 70, 110 are both set to V73=VI+VOFa−VOFa=VI and V56=VI+VOFb−VOFb=VI, which means that offset voltages VOFa, VOFb of driving circuits 70, 110 are canceled. Finally, switches S14*a*, S14*b* are turned on, and a relation of VO=VI is attained.

Driving circuit 185 is used as push-type driving circuit 31 or pull-type driving circuit 32 in FIG. 4 or FIG. 5. When driving circuit 185 is used as push-type driving circuit 31, current drivability of P-type transistor 108 for discharging is set to a sufficiently low level, as compared with that of N-type transistor 73 for charging. When driving circuit 185 is used as pull-type driving circuit 32, current drivability of N-type transistor 73 for charging is set to a sufficiently low level, as compared with that of P-type transistor 108 for discharging. Therefore, the through current in driving circuits 31, 32 can be reduced, and power consumption can be lowered.

In Embodiment 12, driving circuit 185 free of offset voltage and achieving low power consumption is obtained.

Embodiment 13

Figure 36:
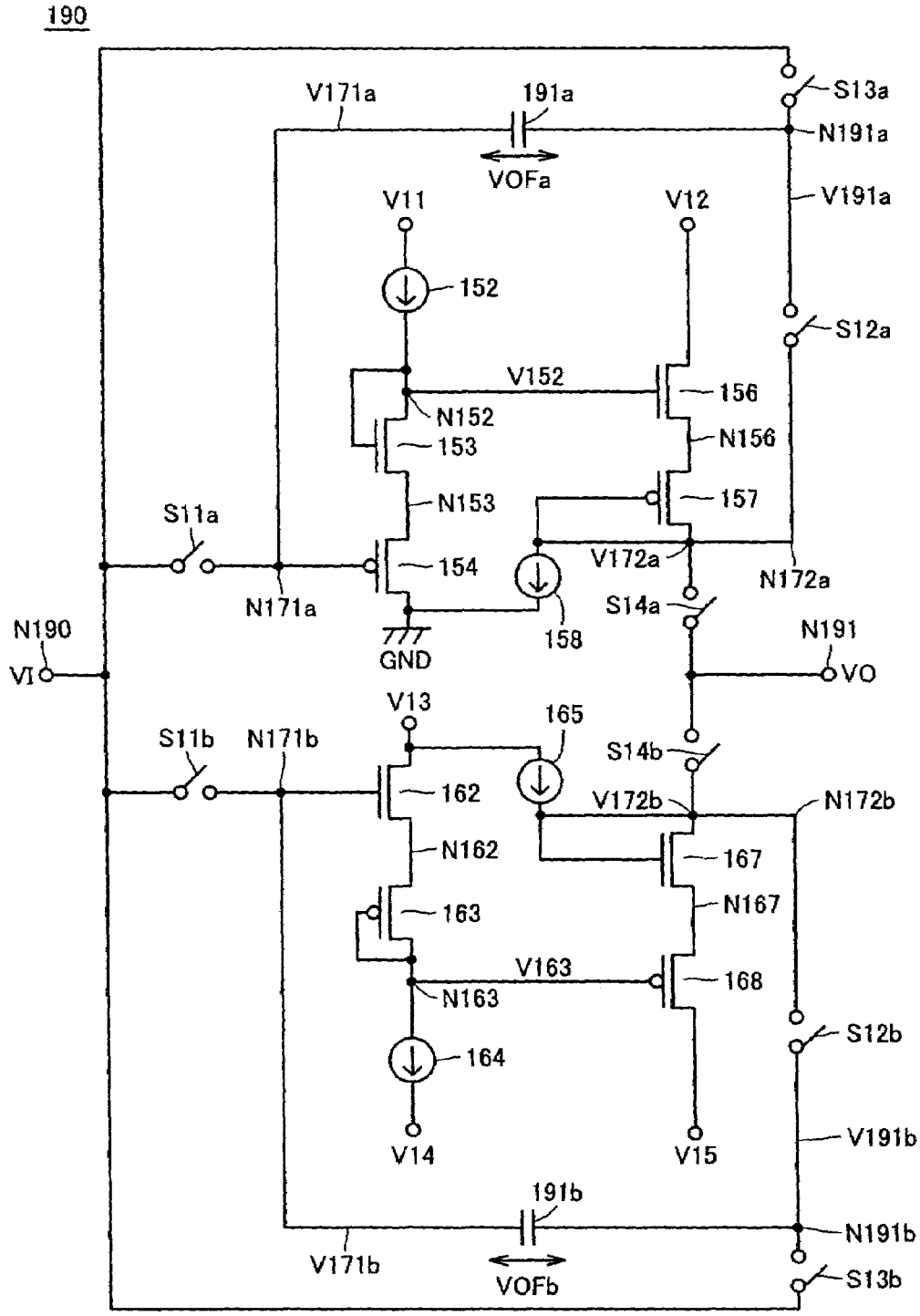
FIG. 36 is a circuit diagram showing a configuration of a push-pull-type driving circuit with an offset compensation function in Embodiment 13 of the present invention.
Figure 37:
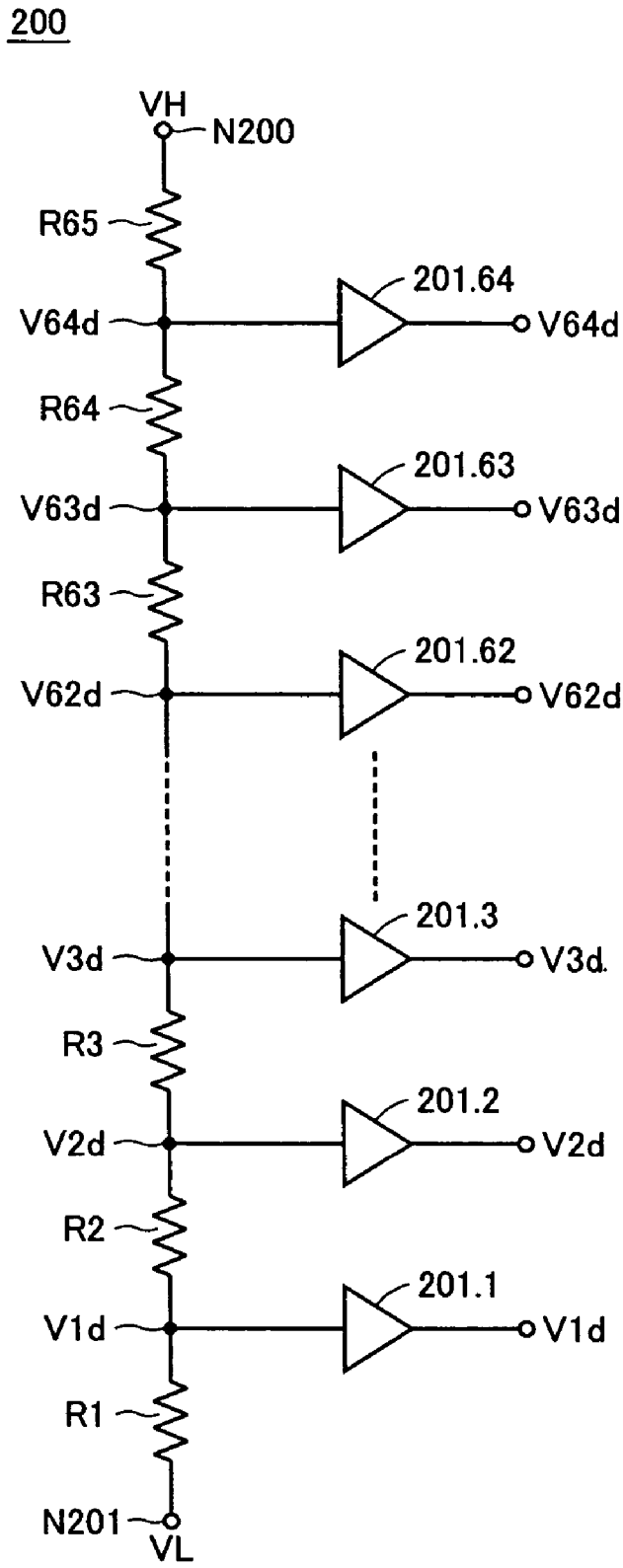
FIG.37 PRIOR ART
FIG. 37 is a circuit diagram showing a configuration of a gradation potential generating circuit in a conventional liquid crystal display device.
Figure 38:
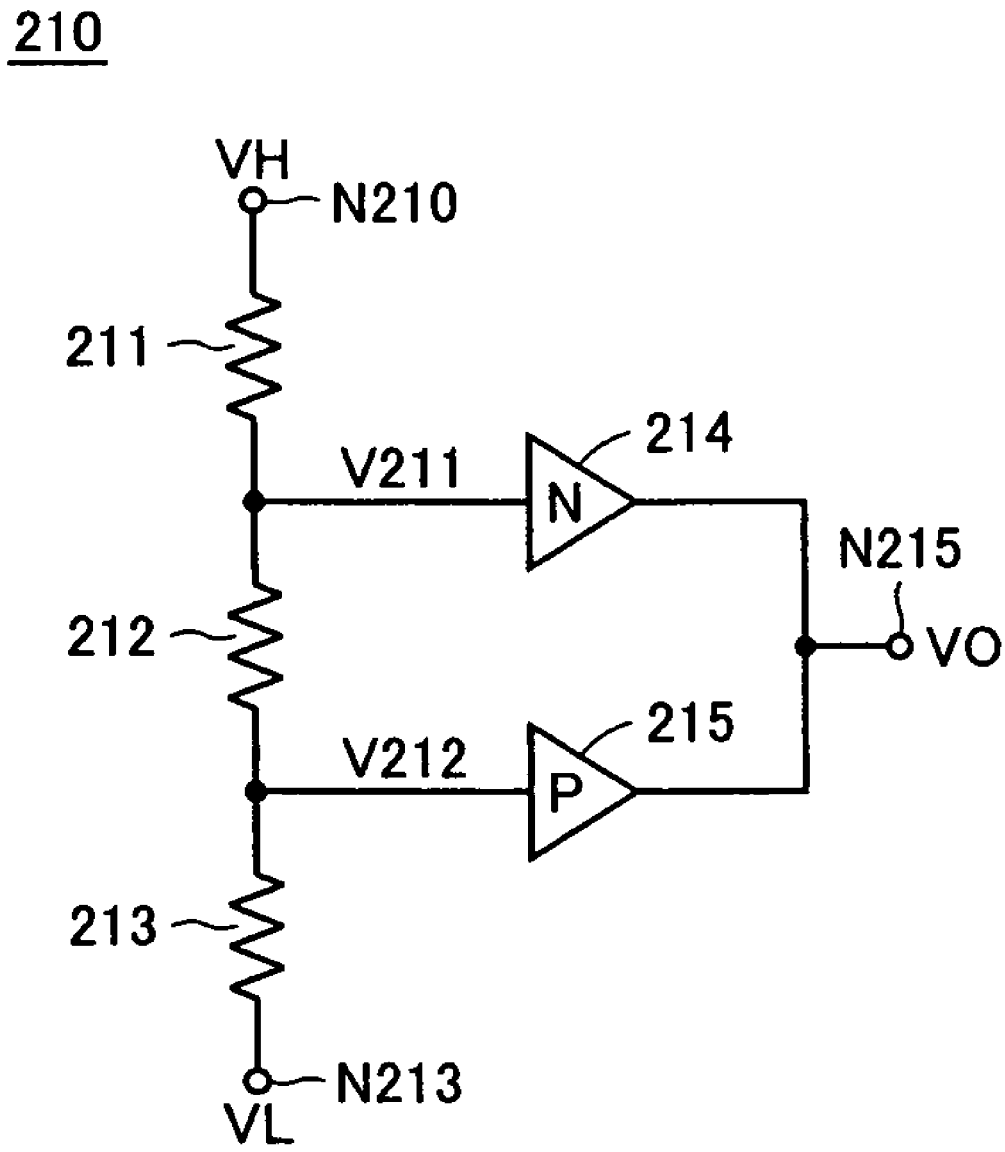
FIG.38 PRIOR ART
FIG. 38 is a circuit diagram showing a configuration of a conventional current amplifier circuit.

FIG. 36 is a circuit block diagram showing a configuration of a driving circuit 190 with an offset compensation function in Embodiment 13 of the present invention. In FIG. 36, driving circuit 190 with the offset compensation function is obtained by adding capacitors 191*a*, 191*b* and switches S11*a* to S14*a*, S11*b* to S14*b* to driving circuit 170 in FIG. 30.

Switches S11*a*, S11*b* are connected between an input node N190 and the gates of transistors 154, 162 (nodes N171*a*, N171*b*) respectively. Switches S14*a*, S14*b* are connected between an output node N191 and the drains of transistors 157, 167 (nodes N172*a*, N172*b*) respectively. Capacitor 191*a* and switch S12*a* are connected in series between nodes N171*a* and N172*a*. Capacitor 191*b* and switch S12*b* are connected in series between nodes N171*b* and N172*b*. Switch S13*a* is connected between input node N190 and a node N191*a* between capacitor 191*a* and switch S12*a*. Switch S13*b* is connected between input node N190 and a node N191*b* between capacitor 191*b* and switch S12*b*.

An operation of driving circuit 190 will now be described. At an initial state, all switches S11*a* to S14*a*, S11*b* to S14*b* are turned off. When switches S11*a*, S12*a*, S11*b*, S12*b* are turned on at a certain time, potentials V172*a*, V172*b* of nodes N172*a*, NI72*b* are set to V172*a*=VI−VOFa and V172*b*=VI−VOFb respectively, and capacitors 191*a*, 191*b* are charged to offset voltages VOFa, VOFb respectively.

When switches S11*a*, S12*a*, S11*b*, S12*b* are turned off, offset voltages VOFa, VOFb are held in capacitors 191*a*, 191*b* respectively. When switches S13*a*, S13*b* are turned on, the gate potentials of transistors 154, 162 are set to VI+VOFa and VI+VOFb respectively. As a result, potentials V172*a*, V172*b* of nodes N172*a*, 172*b* are set to V172*a*=VI+VOFa−VOFa=VI and V172*b*=VI+VOFb−VOFb=VI, which means that offset voltages VOFa, VOFb of driving circuit 170 are canceled. Finally, switches S14*a*, S14*b* are turned on, and a relation of VO=VI is attained.

Driving circuit 190 is used as push-type driving circuit 31 or pull-type driving circuit 32 in FIG. 4 or FIG. 5. When driving circuit 190 is used as push-type driving circuit 31, current drivability of transistors 167, 168 is set to a sufficiently low level, as compared with that of transistors 156, 157. When driving circuit 190 is used as pull-type driving circuit 32, current drivability of transistors 156, 157 is set to a sufficiently low level, as compared with that of transistors 167, 168. Therefore, the through current in driving circuits 31, 32 can be reduced, and power consumption can be lowered.

In Embodiment 13, driving circuit 190 free of offset voltage and achieving low power consumption is obtained.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. An image display device displaying an image in accordance with an image signal, comprising:

a plurality of pixel display elements arranged in a plurality of rows and columns and each performing gradation display in accordance with an applied gradation potential;

a plurality of scanning lines provided corresponding to said plurality of rows respectively;

a plurality of data lines provided corresponding to said plurality of columns respectively;

a vertical scanning circuit successively selecting a scanning line from said plurality of scanning lines for a prescribed time period and activating each pixel display element corresponding to the selected scanning line; and a horizontal scanning circuit providing a gradation potential to each pixel display element activated by said vertical scanning circuit in accordance with said image signal; wherein said horizontal scanning circuit includes a precharge circuit setting each data line to a predetermined precharge potential, a potential generating circuit generating a plurality of gradation potentials different from one another, a first current amplifier circuit provided corresponding to each gradation potential higher than said precharge potential among said plurality of gradation potentials, outputting a potential equal to the corresponding gradation potential, and having charging capability higher than discharging capability, a second current amplifier circuit provided corresponding to each gradation potential lower than said precharge potential among said plurality of gradation potentials, outputting a potential equal to the corresponding gradation potential, and having discharging capability higher than charging capability, and a selection circuit selecting one gradation potential out of said plurality of gradation potentials for each data line in accordance with said image signal and providing to each data line set to said precharge potential, an output potential of said first or second current amplifier circuit corresponding to the selected gradation potential selected for that data line and providing the gradation potential selected for each data line to the activated pixel display element through the data line.

2. The image display device according to claim 1, wherein said first current amplifier circuit includes a first transistor connected between a line of a first power supply potential and a first output node and causing a current to flow into said first output node, a first current restriction element connected between said first output node and a line of a second power supply potential, having current drivability lower than that of said first transistor, and causing a current to flow out from said first output node, and a first control circuit controlling a gate potential of said first transistor such that a potential of said first output node is equal to the corresponding gradation potential, and said second current amplifier circuit includes a second current restriction element connected between a line of a third power supply potential and a second output node and causing a current to flow into said second output node, a second transistor connected between said second output node and a line of a fourth power supply potential, having current drivability higher than that of said second current restriction element, and causing a current to flow out from said second output node, and a second control circuit controlling a gate potential of said second transistor such that a potential of said second output node is equal to the corresponding gradation potential.

3. The image display device according to claim 1, wherein said pixel display element includes a liquid crystal cell of which light transmittance is varied in accordance with said gradation potential, said potential generating circuit includes a voltage-dividing circuit dividing a positive power supply voltage representing a differential voltage between a high potential and a low potential to generate said plurality of gradation potentials during a first period, and dividing a negative power supply voltage representing a differential voltage between said low potential and said high potential to generate said plurality of gradation potentials during a second period, said precharge potential being a potential between said high potential and said low potential, two pairs of said first and second current amplifier circuits are provided, one pair of said first and second current amplifier circuits being activated during said first period and another pair of said first and second current amplifier circuits being activated during said second period, and said selection circuit provides an output potential of the selected first or second current amplifier circuit of said one pair to each, data line set to said precharge potential during the first period, and provides an output potential of the selected first or second current amplifier circuit of said another pair to each data line set to said precharge potential during the second period.

4. The image display device according to claim 1, wherein said pixel display element includes a liquid crystal cell of which light transmittance is varied in accordance with said gradation potential, said potential generating circuit includes a first voltage-dividing circuit dividing a positive power supply voltage representing a differential voltage between a high potential and a low potential to generate said plurality of gradation potentials, and a second voltage-dividing circuit dividing a negative power supply voltage representing a differential voltage between said low potential and said high potential to generate said plurality of gradation potentials, said precharge potential being a potential between said high potential and said low potential, two pairs of said first and second current amplifier circuits are provided, one pair of said first and second current amplifier circuits is provided corresponding to said first voltage-dividing circuit and activated during a first period, another pair of said first and second current amplifier circuits is provided corresponding to said second voltage-dividing circuit and activated during a second period, and said selection circuit provides an output potential of the selected first or second current amplifier circuit of said one pair to each data line set to said precharge potential during said first period, and provides an output potential of the selected first or second current amplifier circuit of said another pair to each data line set to said precharge potential during said second period.

5. The image display device according to claim 2, wherein said first control circuit includes a third transistor connected between a line of a fifth power supply potential and a gate electrode of said first transistor, a fourth transistor having a conductivity type the same as that of said first transistor and having its gate electrode and first electrode connected to the gate electrode of said first transistor, a third current restriction element connected between a second electrode of said fourth transistor and a line of a sixth power supply potential, and a differential amplifier circuit controlling a gate potential of said third transistor such that a potential of the second electrode of said fourth transistor is equal to the corresponding gradation potential.

6. The image display device according to claim 2, wherein said first control circuit includes a third current restriction element connected between a line of a fifth power supply potential and a gate electrode of said first transistor, a third transistor having a conductivity type the same as that of said first transistor and having its gate electrode and first electrode connected to the gate electrode of said first transistor, a fourth transistor connected between a second electrode of said third transistor and a line of a sixth power supply potential, and a differential amplifier circuit controlling a gate potential of said fourth transistor such that a potential of the second electrode of said third transistor is equal to the corresponding gradation potential.

7. The image display device according to claim 2, wherein said second control circuit includes a third transistor having its first electrode connected to a line of a fifth power supply potential, a fourth transistor having a conductivity type the same as that of said second transistor, having its first electrode connected to a second electrode of said third transistor, and having its gate electrode and second electrode connected to a gate electrode of said second transistor, a third current restriction element connected between the second electrode of said fourth transistor and a line of a sixth power supply potential, and a differential amplifier circuit controlling a gate potential of said third transistor such that a potential of the first electrode of said fourth transistor is equal to the corresponding gradation potential.

8. The image display device according to claim 2, wherein said second control circuit includes a third current restriction element having one electrode connected to a line of a fifth power supply potential, a third transistor having a conductivity type the same as that of said second transistor, having its first electrode connected to another electrode of said third current restriction element, and having its second electrode and gate electrode connected to a gate electrode of said second transistor, a fourth transistor connected between the second electrode of said third transistor and a line of a sixth power supply potential, and a differential amplifier circuit controlling a gate potential of said fourth transistor such that a potential of the first electrode of said third transistor is equal to the corresponding gradation potential.

9. The image display device according to claim 1, wherein each of said first and second current amplifier circuits includes a first transistor connected between a line of a first power supply potential and an output node and causing a current to flow into said output node, a second transistor connected between said output node and a line of a second power supply potential and causing a current to flow out from said output node, and a control circuit controlling a gate potential of each of said first and second transistors such that a potential of said output node is equal to the corresponding gradation potential, in said first current amplifier circuit, said first transistor has current drivability higher than that of said second transistor, and in said second current amplifier circuit, said second transistor has current drivability higher than that of said first transistor.

10. The image display device according to claim 9, wherein each of said first and second current amplifier circuits further includes a current restriction element connected between said output node and a line of a third power supply potential.

11. The image display device according to claim 9, wherein said control circuit includes a third transistor connected between a line of a third power supply potential and a gate electrode of said first transistor, a fourth transistor having a conductivity type the same as that of said first transistor and having its gate electrode and first electrode connected to the gate electrode of said first transistor, a first current restriction element connected between a second electrode of said fourth transistor and a line of a fourth power supply potential, a first differential amplifier circuit controlling a gate potential of said third transistor such that a potential of the second electrode of said fourth transistor is equal to the corresponding gradation potential, a second current restriction element having one electrode connected to a line of a fifth power supply potential, a fifth transistor having a conductivity type the same as that of said second transistor, having its first electrode connected to another electrode of said second current restriction element, and having its second electrode and gate electrode connected to a gate electrode of said second transistor, a sixth transistor connected between the second electrode of said fifth transistor and a line of a sixth power supply potential, and a second differential amplifier circuit controlling a gate potential of said sixth transistor such that a potential of the first electrode of said fifth transistor is equal to the corresponding gradation potential.

12. The image display device according to claim 9, wherein said control circuit includes a first current restriction element connected between a line of a third power supply potential and a gate electrode of said first transistor, a third transistor having a conductivity type the same as that of said first transistor and having its gate electrode and first electrode connected to the gate electrode of said first transistor, a fourth transistor connected between a second electrode of said third transistor and a line of a fourth power supply potential, a first differential amplifier circuit controlling a gate potential of saidfourth transistor such that a potential of the second electrode of said third transistor is equal to the corresponding gradation potential, a fifth transistor having its first electrode connected to a line of a fifth power supply potential, a sixth transistor having a conductivity type the same as that of said second transistor, having its first electrode connected to a second electrode of said fifth transistor, and having its gate electrode and second electrode connected to a gate electrode of said second transistor, a second current restriction element connected between the second electrode of said sixth transistor and a line of a sixth power supply potential, and a second differential amplifier circuit controlling a gate potential of said fifth transistor such that a potential of the first electrode of said sixth transistor is equal to the corresponding gradation potential.

13. The image display device according to claim 9, wherein said control circuit includes a third transistor connected between a line of a third power supply potential and a gate electrode of said first transistor, a fourth transistor having a conductivity type the same as that of said first transistorand having its gate electrode and first electrode connected to the gate electrode of said first transistor, a first current restriction element connected between a second electrode of said fourth transistor and a line of a fourth power supply potential, a first differential amplifier circuit controlling a gate potential of said third transistor such that a potential of the second electrode of said fourth transistor is equal to the corresponding gradation potential, a fifth transistor having its first electrode connected to a line of a fifth power supply potential, a sixth transistor having a conductivity type the same as that of said second transistor, having its first electrode connected to a second electrode of said fifth transistor, and having its gate electrode and second electrode connected to a gate electrode of said second transistor, a second current restriction element connected between the second electrode of said sixth transistor and a line of a sixth power supply potential, and a second differential amplifier circuit controlling a gate potential of said fifth transistor such that a potential of the first electrode of said sixth transistor is equal to the corresponding gradation potential.

14. The image display device according to claim 9, wherein said control circuit includes a first current restriction element connected between a line of a third power supply potential and a gate electrode of said first transistor, a third transistor having a conductivity type the same as that of said first transistor and having its gate electrode and first electrode connected to the gate electrode of said first transistor, a fourth current restriction element connected between a second electrode of said third transistor and a line of a second power supply potential, a first differential amplifier circuit controlling a gate potential of said fourth transistor such that a potential of the second electrode of said third transistor is equal to the corresponding gradation potential, a second current restriction element having one electrode connected to a line of a fifth power supply potential, a fifth transistor having a conductivity type the same as that of said second transistor, having its first electrode connected to another electrode of said second current restriction element, and having its second electrode and gate electrode connected to a gate electrode of said second transistor, a sixth transistor connected between the second electrode of said fifth transistor and a line of a sixth power supply potential, and a second differential amplifier circuit controlling a gate potential of said sixth transistor such that a potential of the first electrode of said fifth transistor is equal to the corresponding gradation potential.

15. The image display device according to claim 9, wherein said control circuit includes a third transistor connected between a line of a third power supply potential and a gate electrode of said first transistor, a fourth transistor having a conductivity type the same as that of said first transistor and having its gate electrode and first electrode connected to the gate electrode of said first transistor, a fifth transistor having a conductivity type the same as that of said second transistor, having its first electrode connected to a second electrode of said fourth transistor, and having its gate electrode and second electrode connected to a gate electrode of said second transistor, a current restriction element connected between the second electrode of said fifth transistor and a line of a fourth power supply potential, and a differential amplifier circuit controlling a gate potential of said third transistor such that a potential of the second electrode of said fourth transistor is equal to the corresponding gradation potential.

16. The image display device according to claim 9, wherein said control circuit includes a current restriction element connected between a line of a third power supply potential and a gate electrode of said first transistor, a third transistor having a conductivity type the same as that of said first transistor and having its gate electrode and first electrode connected to the gate electrode of said first transistor, a fourth transistor having a conductivity type the same as that of said second transistor, having its first electrode connected to a second electrode of said third transistor, and having its gate electrode and second electrode connected to a gate electrode of said second transistor, a fifth transistor connected between the second electrode of said fourth transistor and a line of the corresponding power supply potential, and a differential amplifier circuit controlling a gate potential of said fifth transistor such that a potential of the first electrode of said fourth transistor is equal to a fourth gradation potential.

17. The image display device according to claim 1, wherein said first current amplifier circuit includes a first level shift circuit outputting a potential higher than the corresponding gradation potential by a prescribed voltage, a pull-up circuit charging a first output node to a potential lower than the output potential of said first level shift circuit by said prescribed voltage, and a first current restriction element connected between said first output node and a line of a first power supply potential, having current drivability lower than that of said pull-up circuit, and causing a current to flow out from said first output node, and said second current amplifier circuit includes a second level shift circuit outputting a potential lower than the corresponding gradation potential by said prescribed voltage, a pull-down circuit discharging a second output node to a potential higher than the output potential of said second level shift circuit by said prescribed voltage, and a second current restriction element connected between a line of said second power supply potential and said second output node, having current drivability lower than that of said pull-down circuit, and causing a current to flow into said second output node.

18. The image display device according to claim 1, wherein each of said first and second current amplifier circuits includes a first level shift circuit outputting a potential higher than the corresponding gradation potential by a prescribed voltage, a pull-up circuit charging an output node to a potential lower than the output potential of said first level shift circuit by said prescribed voltage, a second level shift circuit outputting a potential lower than the corresponding gradation potential by said prescribed voltage, and a pull-down circuit discharging said output node to a potential higher than the output potential of said second level shift circuit by said prescribed voltage, in said first current amplifier circuit, said pull-up circuit has current drivability higher than that of said pull-down circuit, and in said second current amplifier circuit, said pull-down circuit has current drivability higher than that of said pull-up circuit.

19. The image display device according to claim 18, wherein each of said first and second current amplifier circuits further includes a current restriction element connected between said output node and a line of a power supply potential.

20. The image display device according to claim 1, wherein said horizontal scanning circuit further includes an offset compensation circuit provided corresponding to each of said first and second current amplifier circuits, detecting an offset voltage in the corresponding current amplifier circuit, and canceling the offset voltage in the corresponding current amplifier circuit based on a detection result.

* * * * *